US006405864B1

(12) United States Patent
Streich et al.

(10) Patent No.: US 6,405,864 B1
(45) Date of Patent: Jun. 18, 2002

(54) TOOL CONTAINER

(75) Inventors: John P. Streich, Appleton, WI (US); Daniel G. Findle, White Hall, MD (US); Patrick S. Keenan; David Namey, Jr., both of Pittsburgh, PA (US); Gregory S. Snider, Bel Air, MD (US); James Pangerc, Baltimore, MD (US); Matthew J. Holland, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/696,777

(22) Filed: Oct. 26, 2000

Related U.S. Application Data

(60) Division of application No. 09/372,743, filed on Aug. 11, 1999, now Pat. No. 6,213,296, which is a continuation-in-part of application No. 09/134,109, filed on Aug. 14, 1998.

(51) Int. Cl.[7] ..... B65D 85/28

(52) U.S. Cl. ..... 206/373; 206/378; 206/443; 211/69

(58) Field of Search ..... 206/372, 373, 206/376, 377, 379, 443, 1.5, 387.13, 564, 565, 486, 480; 211/69; 292/80, 87, 97, 99; 220/324; 156/153, 73.1, 293, 294

(56) References Cited

U.S. PATENT DOCUMENTS 337,888 A * 3/1886 Swan
470,567 A * 3/1892 Hitch
498,455 A * 5/1893 Bartlett
1,927,110 A * 9/1933 Bannister et al.
2,035,033 A * 3/1936 Wakefield
2,487,174 A * 11/1949 Petre
2,508,951 A * 5/1950 Kazimier
2,601,101 A * 6/1952 Derham
D167,868 S * 9/1952 Selikoff et al.
D178,627 S * 9/1956 Baratelli (List continued on next page.)

FOREIGN PATENT DOCUMENTS

DE 1085810 7/1960

*Primary Examiner*—Shian Luong
(74) *Attorney, Agent, or Firm*—Harness, Dickey & Pierce, P.L.C.

(57) ABSTRACT

A tool container (20, 520, 620) has a pair of clamshell housing members (22, 24, 422, 424) hingedly coupled to be moved between opened and closed positions. At least one of the members (22, 24, 422, 424) defines a cavity defined by a base (42, 44, 442, 444) and a wall (58, 60, 62, 64, 458, 460, 462, 464) extending from the base (42, 44, 442, 444), and a two-retaining insert (32, 34, 36, 37, 431, 433) is provided in the cavity. The insert (32, 34, 36, 37, 431, 433) and wall (58, 60, 62, 64, 458, 460, 462, 464) include alternating complementary dovetail tenons (74, 132, 474, 532) and recesses (76, 134, 476, 534) secure a tool-retaining insert in the cavity of the housing member (22, 24, 422, 424). The tool-retaining insert (32, 34, 36, 37, 431, 433) includes a number of tool-receiving recesses (120, 520, 620) therein with tool-receiving cradles (152, 552, 652) and various alternate retaining finger arrangements (124, 524, 525, 624) being provided for releasably retaining elongated tools (170, 570, 670) therein and for facilitating the ease of their removal. Such alternate arrangements including opposed pairs of tool-retaining fingers (124, 524, 525, 624) and split finger (624) configurations. A latch mechanism (28, 428) is included to releasably lock the pair of housing members (22, 24, 422, 424) in their closed position.

22 Claims, 16 Drawing Sheets

U.S. PATENT DOCUMENTS 2,792,934 A * 5/1957 Rocchetti
2,844,244 A * 7/1958 Hanson
D183,777 S * 10/1958 Weiss
2,880,857 A * 4/1959 Parsons et al.
3,018,876 A * 1/1962 Huot
3,154,192 A * 10/1964 Cowley
3,186,197 A * 6/1965 Gehrie
3,276,847 A * 10/1966 Duff et al.
3,346,137 A * 10/1967 Ricci
3,367,483 A * 2/1968 Studen
3,370,697 A 2/1968 Levey et al.
3,383,009 A 5/1968 Weikert
3,426,890 A 2/1969 Bayer
3,499,525 A 3/1970 Kanter
3,583,556 A 6/1971 Wagner
D221,317 S 7/1971 Muller
D229,366 S 11/1973 Yonce
3,904,034 A 9/1975 Saunders
4,048,051 A 9/1977 Gretz
4,216,862 A 8/1980 Daenen
4,253,830 A 3/1981 Kazen et al.
4,260,057 A 4/1981 Wall-Andersen
D264,396 S 5/1982 Harvey et al.
4,340,140 A 7/1982 Wilcox et al.
D269,648 S 7/1983 Wilcox et al.
4,489,830 A 12/1984 Charlebois et al.
4,576,307 A 3/1986 Frydenberg
4,615,464 A 10/1986 Byrns
4,619,364 A 10/1986 Czopor, Jr.
D287,906 S 1/1987 Tsuji et al.
D291,946 S 9/1987 Dottori et al.
4,714,158 A 12/1987 Oltman et al.
4,889,254 A 12/1989 Vola
4,958,732 A 9/1990 Rau et al.
D311,644 S 10/1990 Chapin et al.
4,974,740 A 12/1990 Niles et al.
D314,669 S 2/1991 Kunimune
5,031,768 A 7/1991 Fischer
5,056,661 A 10/1991 Balzano
5,114,007 A 5/1992 Chen
D328,189 S 7/1992 Hillinger
5,133,455 A 7/1992 Chow
D329,331 S 9/1992 Hobson
5,156,271 A 10/1992 Toner
5,217,115 A 6/1993 Purkapile
5,222,619 A 6/1993 Gregory
5,248,030 A 9/1993 Tarozzi
5,248,033 A 9/1993 Kos et al.
D343,063 S 1/1994 Chen
D343,120 S 1/1994 Lapsker et al.
D345,650 S 4/1994 Boyd
D347,114 S 5/1994 Tengvall
5,316,159 A 5/1994 Douglas et al.
5,320,223 A 6/1994 Allen
5,341,926 A 8/1994 Leben
5,346,063 A 9/1994 Chow
5,346,677 A 9/1994 Risk
5,368,164 A 11/1994 Bennett et al.
5,398,810 A 3/1995 Yao Wang
D356,891 S 4/1995 Hobson
5,409,560 A 4/1995 Hammer et al.
D358,257 S 5/1995 Sidabras et al.
5,429,235 A 7/1995 Chen
5,433,929 A 7/1995 Riihimaki et al.
5,464,091 A 11/1995 Callahan et al.
5,469,961 A 11/1995 Chang
5,484,057 A 1/1996 Tzu-Ching
5,509,731 A 4/1996 Callahan et al.
5,520,285 A 5/1996 Mursch et al.
5,524,915 A 6/1996 Liu
5,525,314 A 6/1996 Hurson
5,526,929 A 6/1996 Wei
5,535,881 A 7/1996 Krivec
5,551,795 A 9/1996 Engibarov
5,553,710 A 9/1996 Takama
D374,988 S 10/1996 Hillinger
5,560,572 A 10/1996 Osborn et al.
5,562,208 A 10/1996 Hasler et al.
5,570,784 A 11/1996 Sidabras et al.
5,588,240 A 12/1996 Zilliox
5,603,415 A 2/1997 Balnis, Jr.
5,624,037 A 4/1997 Kozo
D379,715 S 6/1997 Yemini
5,638,838 A 6/1997 Lonbardi
5,638,964 A 6/1997 Ernst
5,641,066 A 6/1997 Mascaro
5,649,657 A 7/1997 Chuang
5,651,941 A 7/1997 Stark et al.
D382,115 S 8/1997 Chang
D382,709 S 8/1997 Cuneo
D385,109 S 10/1997 Stäheli
5,676,254 A 10/1997 Cheng et al.
D391,321 S 2/1998 Hill
5,730,511 A 3/1998 Doan et al.
D394,952 S 6/1998 Wei
5,803,254 A 9/1998 Vasudeva
5,826,719 A 10/1998 Chen
D400,709 S 11/1998 Chang
5,934,463 A 8/1999 Yu
5,950,352 A 9/1999 Volmer

* cited by examiner

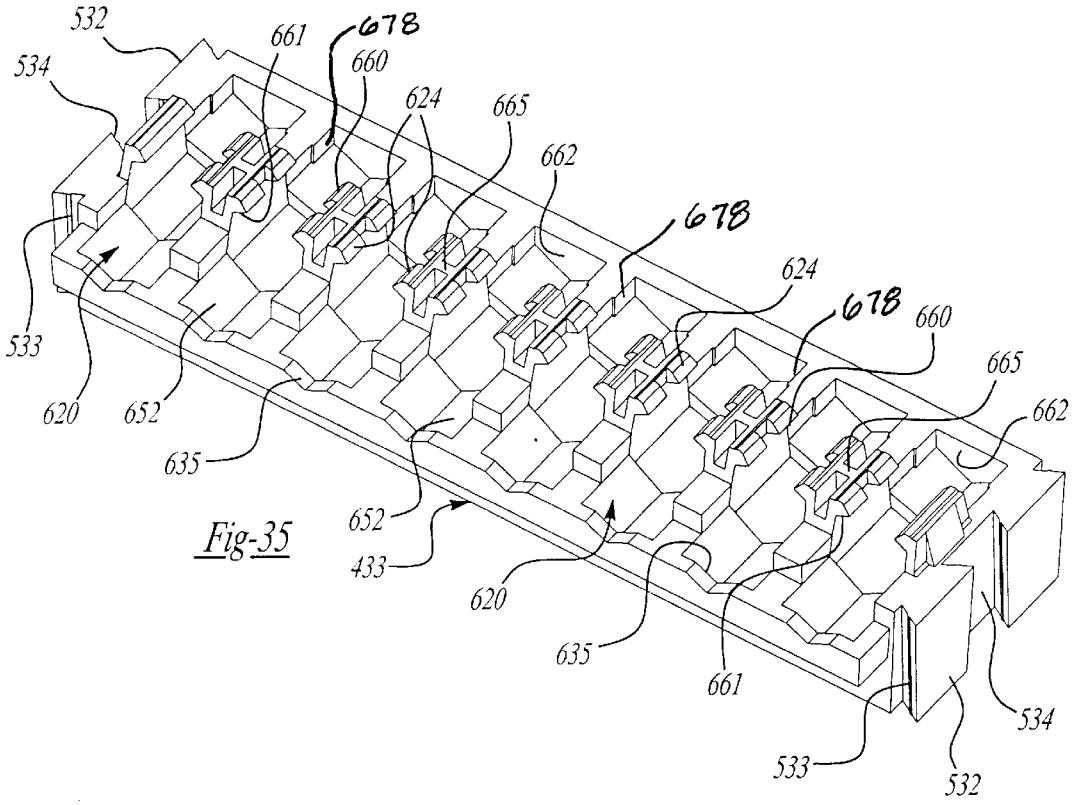
Fig-35
Fig-36
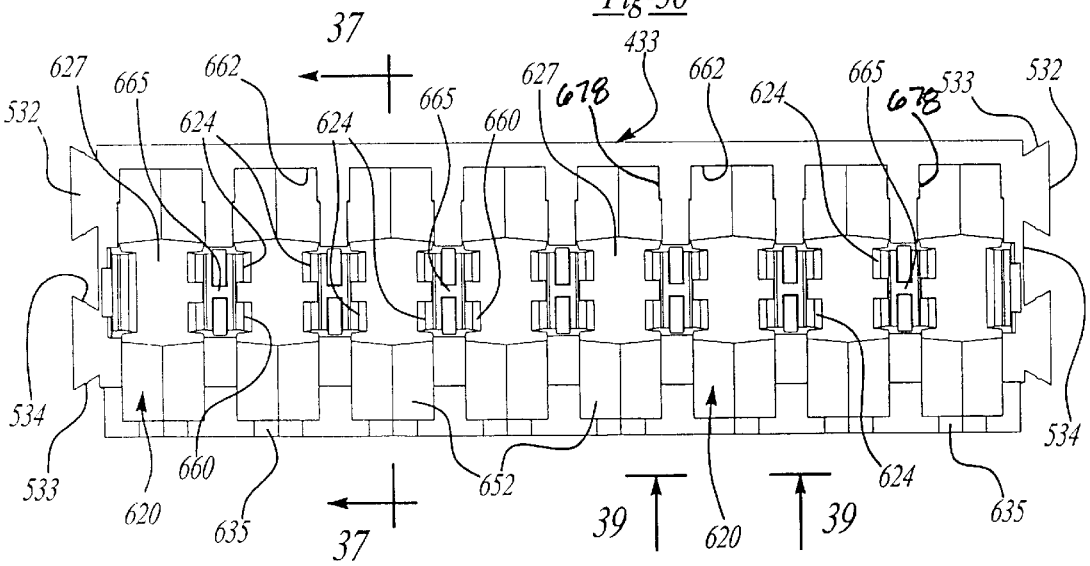

TOOL CONTAINER

This is a division of U.S. patent application Ser. No. 09/372,743, filed Aug. 11, 1999, now U.S. Pat. No. 6,213, 296 which is a continuation-in-part of Ser. No. 09/134,109, filed Aug. 14, 1998.

BACKGROUND AND SUMMARY OF THE INVENTION

The present invention relates to tool containers and, more specifically, to containers which include inserts to retain the tools within the container.

Tool users, whether casual or professional, strive to maintain their tools in some type of organized fashion. Tool organization enables a user to readily find the desired tool, use it, and return it to its storage place. Thus, several types of tool containers have been provided to serve such a function.

While most previous tool containers work satisfactorily for their designed purpose, these containers have their drawbacks. One such drawback is that some containers are not rugged enough to withstand the day-to-day punishment to which a professional user subjects his tools. Also, the previous containers are often inordinately large, awkward or difficult to handle. Further, many previous containers do not provide an aesthetic appearance.

The present invention provides the art with a tool container that overcomes the above shortcomings and that is durable and easily used and manipulated by the user. The present tool case is rugged enough to withstand the daily use of a professional user, while providing a pleasing aesthetic appearance.

In accordance with the invention, a tool container comprises a pair of housing members pivotally coupled to open and close with respect to one another. At least one of such housing members define a recessed cavity for receiving tools such as drill bits, driver bits, or the like. The recessed cavity is preferably defined by a base and a peripheral wall extending generally perpendicularly or at least transversely from the base. One or more tool receiving inserts is permanently secured at any of a variety of positions in the housing. The insert has a surface mechanism to secure it to the housing member base or wall, which can be comprised of a plurality of alternating dovetail recesses and tenons on the insert and on the walls. The tenons on either the insert or the walls are received by opposing recesses on the other of the insert or the wall. The tenons preferably have a front face that is angled with respect to vertical at about one (1°) degree. The recesses have a similar surface angled correspondingly to the front face of the tenon in order to lock the insert within the cavity. The tenons on either the housing member walls or the inserts can have generally vertically extending rib or other protrusion to enhance the wedged, frictional interlock therebetween. Alternatively, the housing base may have a surface that has a plurality of discontinuities or that is "roughened". Likewise, the insert can also have a surface that has similar discontinuities or ribs or that is similarly "roughened" so that such surfaces of the inserts and the walls can be ultrasonically welded together or frictionally interlocked.

The pivotally attached housing members are preferably provided with a locking mechanism including a rail member on each housing member and a latch with a channel configuration for sliding on the rail members between locked and unlocked positions. The rail members, as well as the channel for receiving the rail, are both preferably arcuate in longitudinal and lateral directions. Further, the latch can include first and second indicia that are of contrasting colors and indicate locked and unlocked positions. Alternatively the "locked" and "unlocked" indicia can be formed on the container adjacent the latch. The preferred latch member is constructed of first inner and second outer members, with the first inner member providing rigidity and optionally including a portion which projects through the second outer member.

The tool receiving insert includes a body with a plurality of tool-retaining recesses with V-shaped tool-receiving cradles and tool-retaining finger portions that preferably self-orientate the tool bits in the cradle. The fingers, if necessary, rotate the tool bit to a proper orientation (either circumferentially or axially) to seat the tool bit with an apex of a hex-shaped tool bit within the apex of the V-shaped tool-receiving cradle. The V-shaped cradle preferably has one or more apertures dividing the cradle into two spaced V-shaped cradle portions. One or more pairs or sets of tool-retaining fingers are positioned adjacent this aperture to enable flexing of the fingers which, in turn, enables the fingers to spread apart to receive a tool bit being inserted into the V-shaped cradle. The fingers can be resilient and can include protrusions thereon to urge the tool into a snug, rattle-free engagement with the tool-retaining recesses and cradle portions. A wall portion or socket is provided at an end of the insert adjacent the tool receiving V-shaped cradles. The tools can be slid or snapped into and out of the tool-receiving recesses.

Other objects, features and advantages of the present invention will become more fully apparent from the following detailed description of the preferred embodiment and the accompanying drawings.

BRIEF DESCRIPTION OF THE DRAWINGS

FIG. 35 is a perspective view similar to that of FIG. 29, but illustrating another tool-receiving insert of FIG. 28.

FIG. 36 if top view of the tool-receiving insert of FIG. 35.

DETAILED DESCRIPTION OF THE PREFERRED EMBODIMENTS

Figure 1:
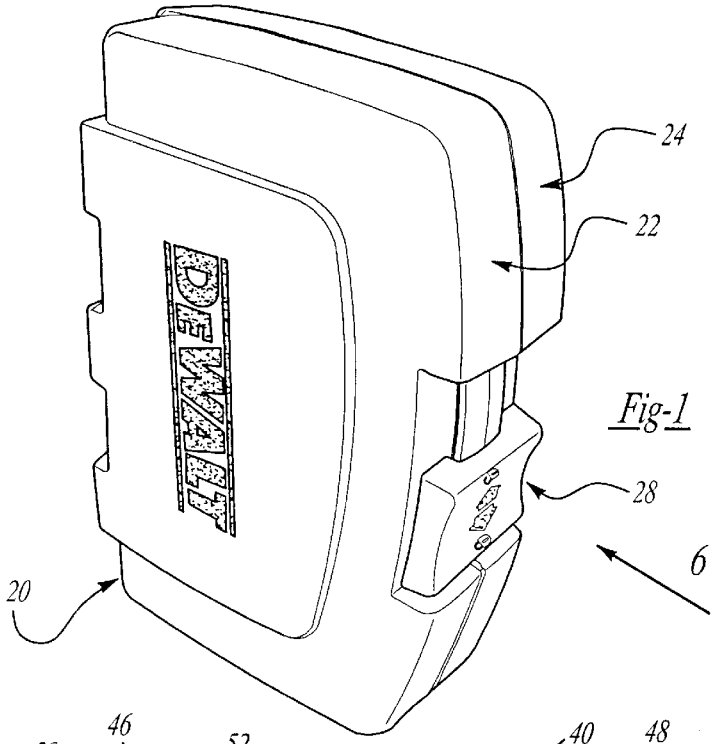
FIG. 1 is a perspective view of a tool container of the present invention shown in a closed position.

FIGS. 1 through 41 illustrate various exemplary embodiments of tool containers in accordance with the present invention. One skilled in the art will readily recognize that the principles of the present invention are equally applicable to other tool containers or tool-receiving inserts for such containers other than those shown merely for purposes of illustration in the drawing figures.

Turning to the figures, particularly FIG. 1, an exemplary tool container is shown and designated with the reference numeral 20. The tool container 20 includes two housing members 22 and 24 pivotally secured together by a hinge 26. The housing members 22, 24 also include a locking mechanism 28 to releasably maintain the container 20 in a closed position.

Figure 2:
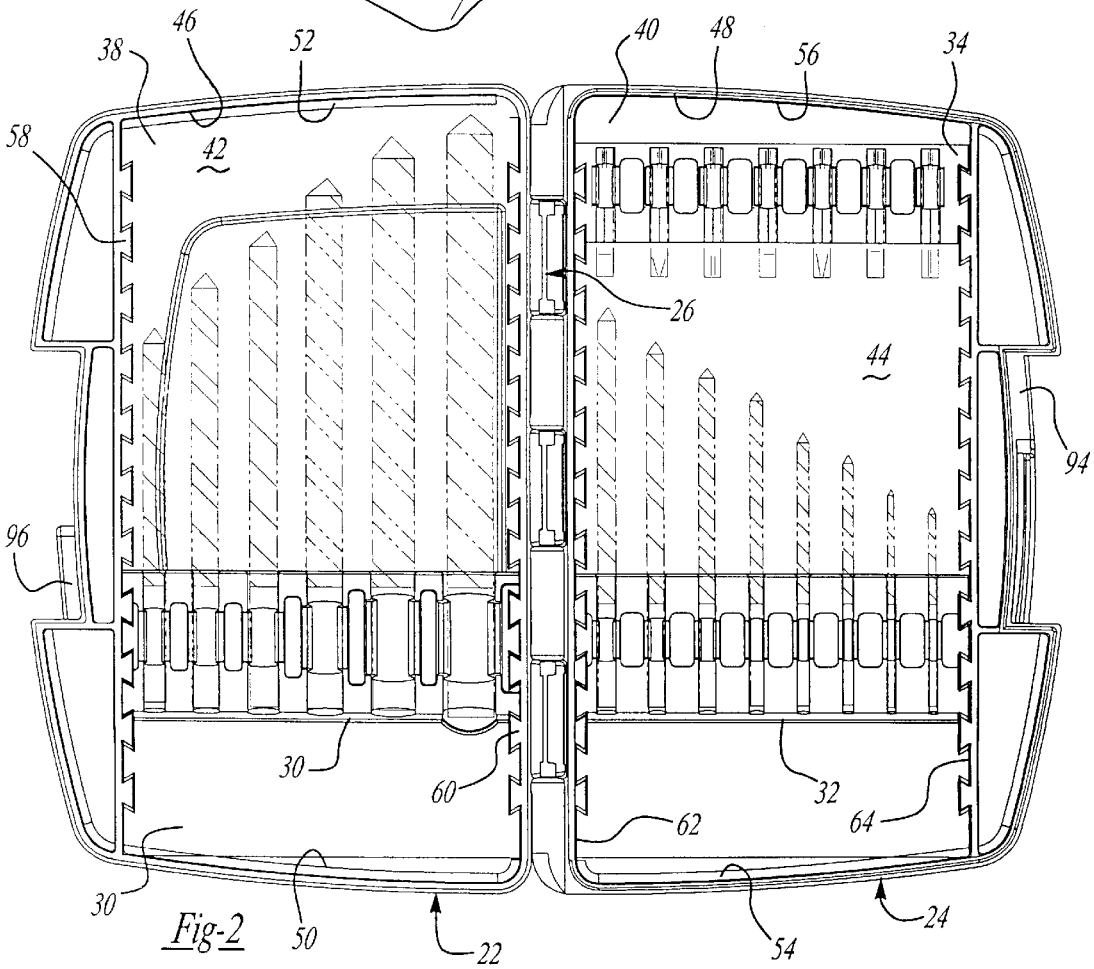
FIG. 2 is a view of the tool container of FIG. 1 shown in an open position.

In FIG. 2, the container 20 is illustrated in an open position, with housing member including one or more tool-receiving or tool-retaining inserts 30, 32 and 34. The tool retaining inserts may be used to retain tool bits, such as drill bits, driver bits, extensions for such bits or other wholly or partially elongated tool items.

Figure 3:
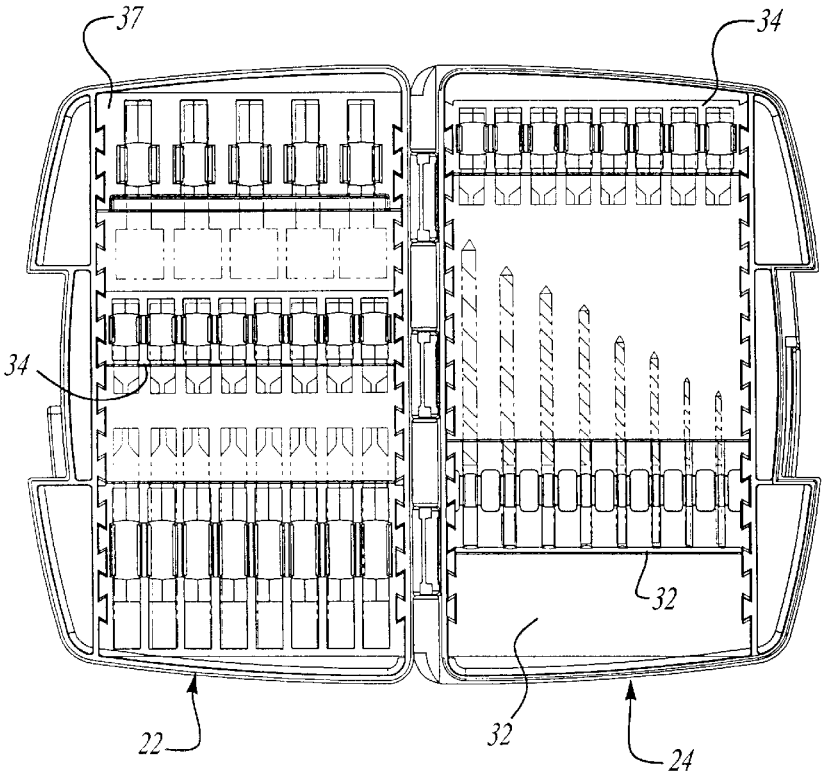
FIG. 3 is a view similar to that of FIG. 2 but illustrating other tool-receiving inserts.
Figure 4:
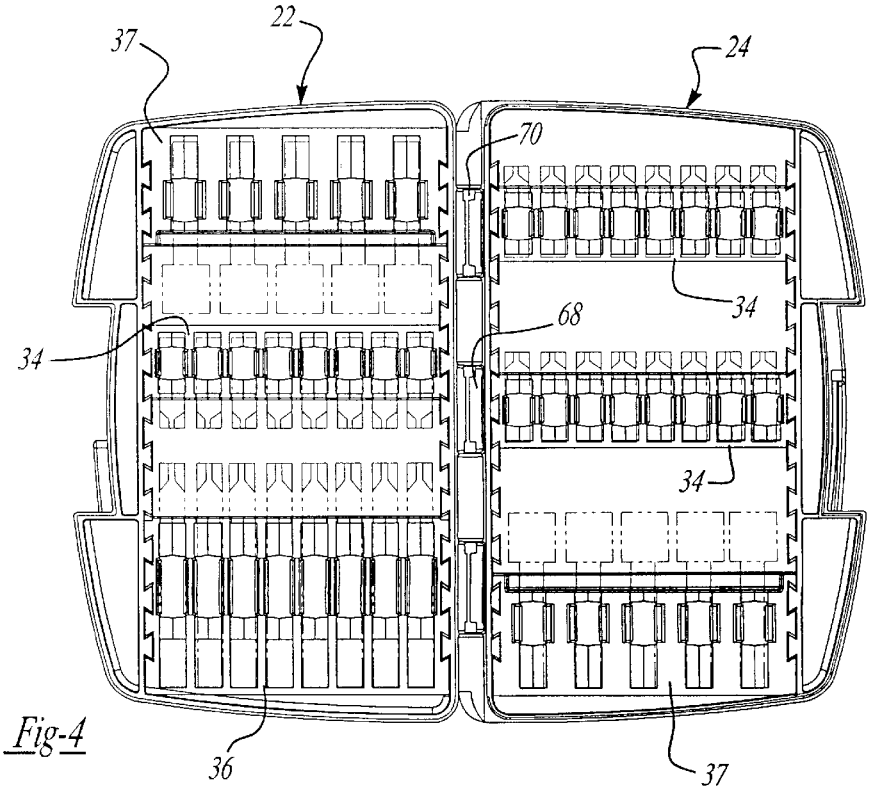
FIG. 4 is a view similar to that of FIGS. 2 or 3, but illustrating still other tool-receiving inserts positioned in other positions.

FIGS. 3 and 4 illustrate embodiments like that of FIG. 2, but with inserts 32, 34, 36 and 37 shown in various or multiple positions or orientations in the housing members 22 and 24.

The housing members 22 and 24 are similar and include recessed cavities 38 and 40, each defined by bases 42 and 44, respectively and peripheral walls 46 and 48, respectively. The housing members 22 and 24 have generally rectangular shapes with the peripheral walls 46 and 48 including lateral walls 50, 52, 54 and 56 and longitudinal walls 58, 60, 62 and 64. The longitudinal walls 60 and 62 include a hinge assembly 26 including hinge members 68, each having a generally C-shape that snap fits onto respective pin members 70 separated by barrel members 72.

Figure 5:
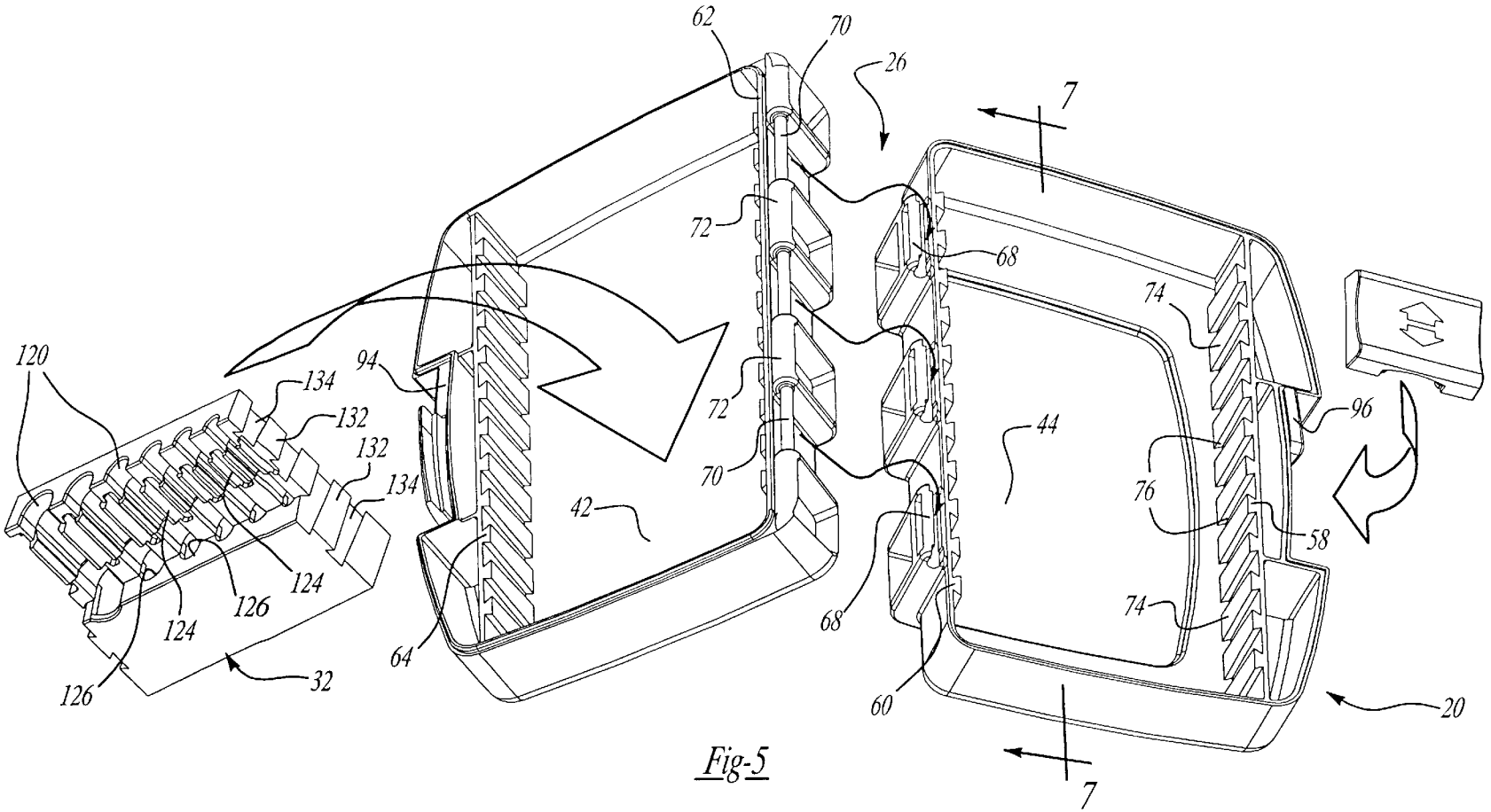
FIG. 5 is an exploded view of the tool container of FIGS. 1 and 2.
Figure 7:
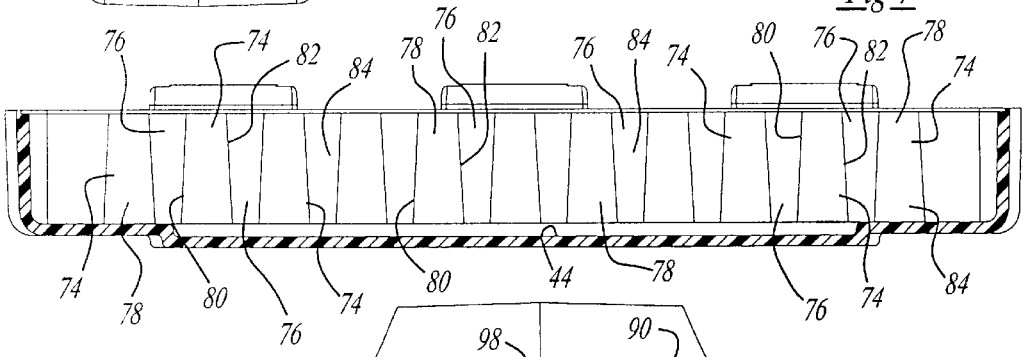
FIG. 7 is a cross-section view taken generally along line 7—7 of FIG. 5.
Figure 10:
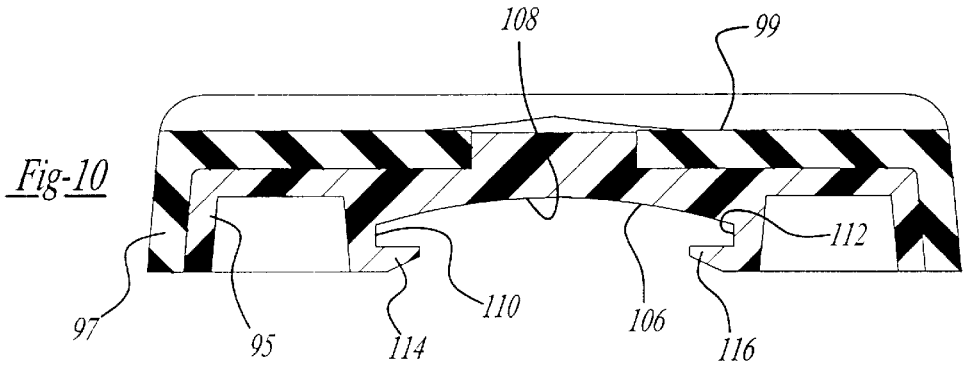
FIG. 10 is a cross-section view taken generally along line 10—10 of FIG. 9.

Referring to FIGS. 5 and 7, the longitudinal walls 58, 60, 62 and 64 include a plurality of alternating dovetail tenons 74 and corresponding recesses 76. The tenons 74 are preferably narrower at the top and wider at the base, thus having a generally trapezoidal shape. The tenons 74 have a front face 78 that is angled with respect to vertical direction at an angle of about one (1°) degree. Also, the tenons 74 have side faces 80 and 82 that define the sides of the recesses 76, and that are likewise angled with respect to vertical direction at an angle of about two (2°) degrees. The recesses 76, which are defined by the side faces 80 and 82, include a rear face 84 that is angled with respect to the vertical direction. Also, each recess 76 has a larger opening at the top of the wall, becoming narrow or tapered near the bases 42 and 44 to form a generally overall trapezoidal shape. The tenons 74 and the recesses 76 thus have dovetail shapes and are adapted to receive the corresponding dovetail recesses and tenons, respectively, of the tool retaining inserts 30, 32, 34, 36 and 37 as seen in FIG. 10. Once the tenons and recesses of the walls and inserts are interlockingly coupled with one another, due to wedging and frictional forces, they are substantially permanently retained within the respective housing cavities.

Figure 6:
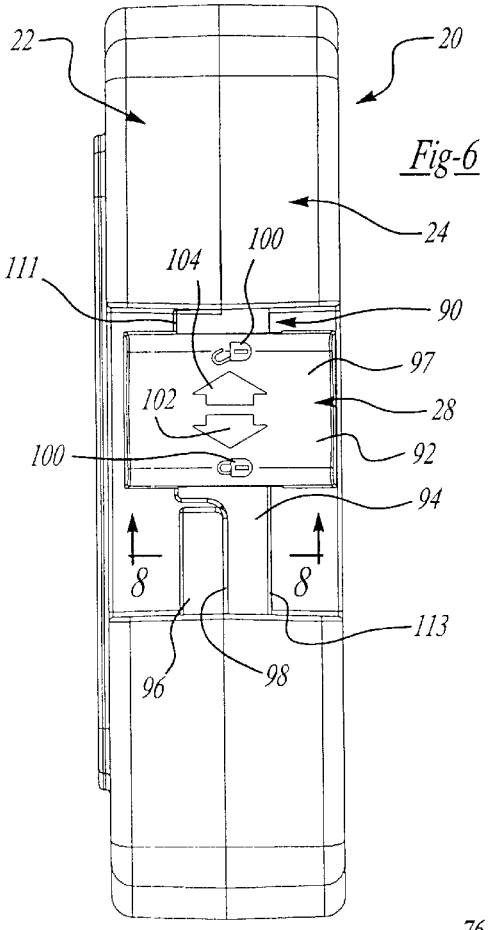
FIG. 6 is a view looking generally in the direction of arrow 6 in FIG. 1.
Figure 8:
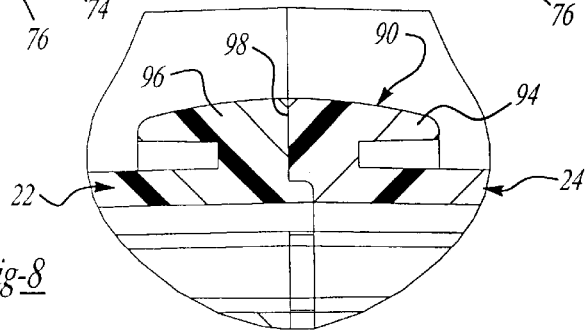
FIG. 8 is a cross-section view taken generally along line 8—8 of FIG. 6.

Referring to FIGS. 6 and 8, the tool container's locking mechanism 28 includes a split rail 90 and a latch 92. The rail 90 includes rail portions 94 and 96 on respective housing members 24 and 22. The rail portion 94 extends above the longitudinal wall 64 to retain the latch 92, and the rail portion 96, which extends along approximately half the width of the rail 90, fits into a cut-out 98 in the rail portion 94 so that in a closed position, as illustrated in FIG. 6, the rail 90 is generally continuous. Thus when the latch 92 is slidably moved along the rail 90 to a locked position, the rail portion 96 and the rail portion 94 are held together by the latch 92, thus latching the housing members 22 and 24 together in their closed position.

The rail portions 94 and 96 are preferably arcuate longitudinally along the rail 90, as seen in FIG. 1, for example. Likewise, the rail portions 94 and 96 are arcuate in a direction transverse to the rail 90, as seen in FIG. 8. Thus, with the rail 90 being arcuate in two directions, it follows the overall contour of the tool container 20. This transverse and longitudinally arcuate shape also enhances removal of the housing members from their dies after being injection molded or otherwise formed.

Figure 9:
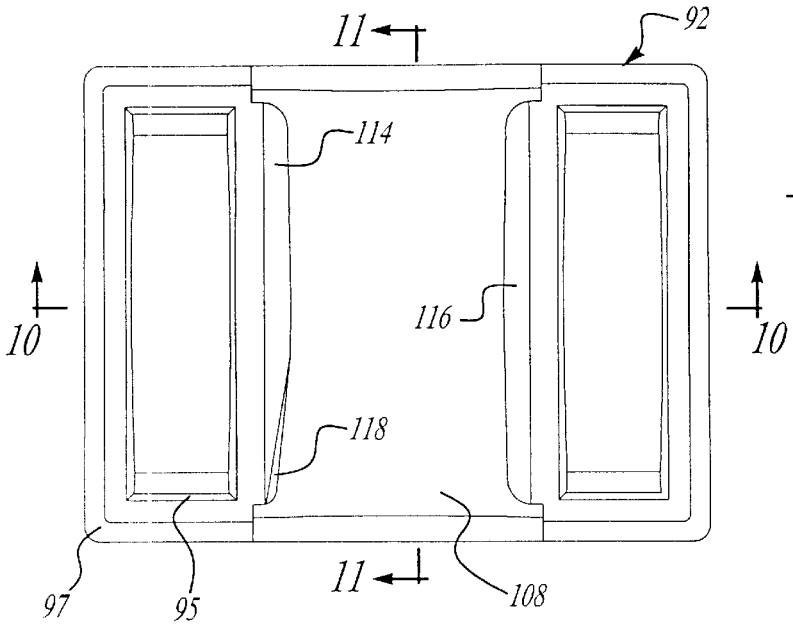
FIG. 9 is a rear or lower view of a tool container latch in accordance with the present invention.

In FIG. 9, the latch 92 has a generally rectangular shape and is preferably formed from a first rigid polypropylene inner member 95 and a second krayton soft cover or outer layer 97. The cover 97 is molded onto the rigid base 95 to provide a soft gripping surface for the user, with the latch 92 having an outer arcuate surface 99 adapted to be grippingly contacted by the user's thumb or finger and has a pleasing ergonomic feel as it is moved between the locked and unlocked positions.

Figure 11:
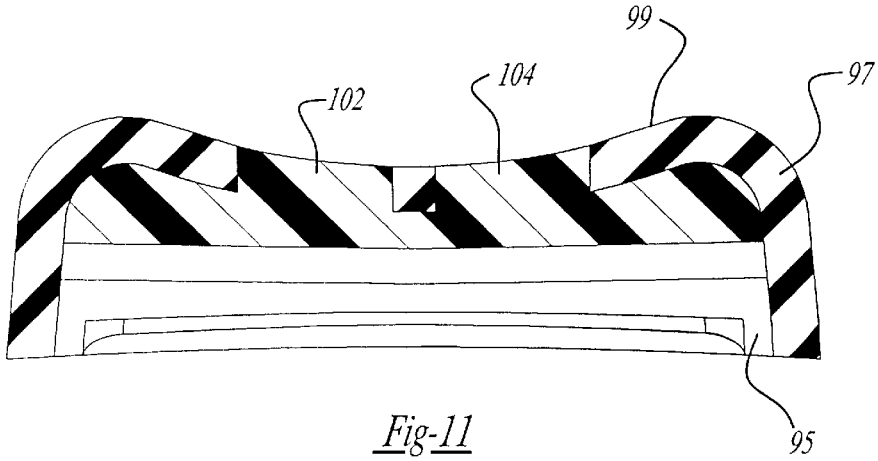
FIG. 11 is another cross-section view taken generally along line 11—11 FIG. 9.
Figure 12:
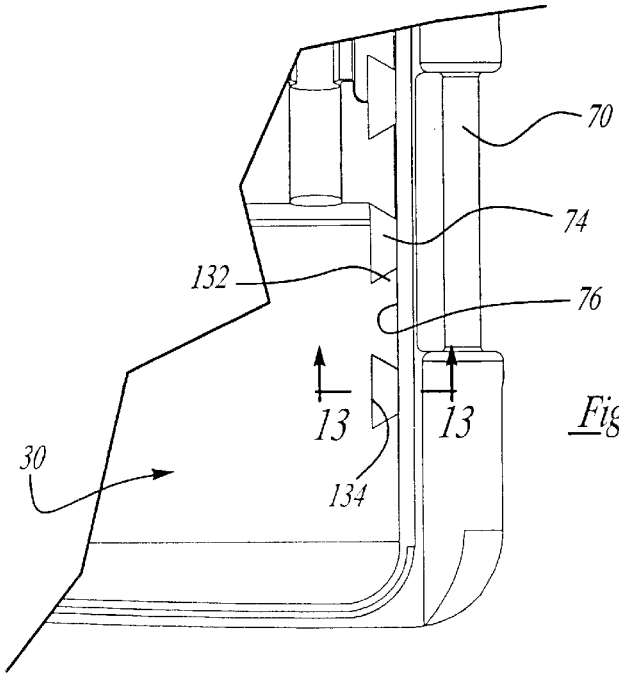
FIG. 12 is an enlarged partial view of one of the housing members of FIG. 2.
Figure 13:
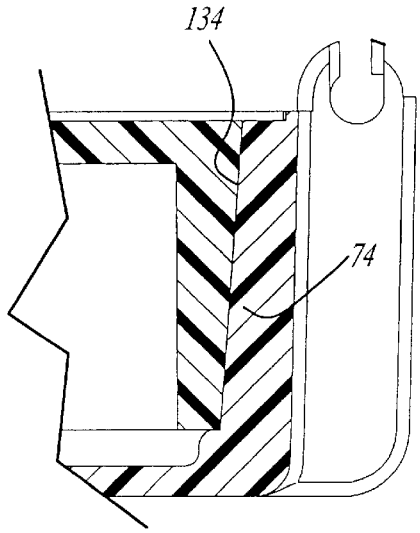
FIG. 13 is a cross-section view taken generally along line 13—13 of FIG. 12.
Figure 14:
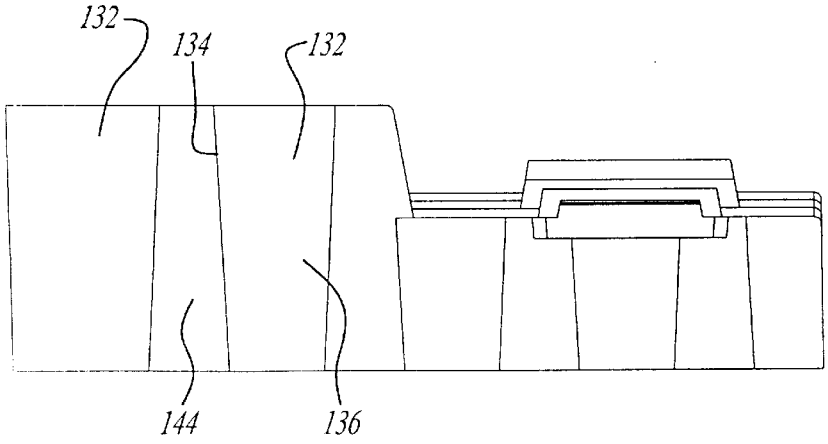
FIG. 14 is an end view of the tool-receiving insert of FIG. 5.

The outer arcuate surface 99 preferably includes indicia 100 formed in the cover member 97 to indicate the locked or unlocked position. Also, as shown in FIGS. 6 and 11, the preferred first member 95 includes indicia members 102 and 104 that project into and through the cover 97. The indicia members 102 and 104 also have an arcuate outer surface consistent with the contour of the first member 94. The indicia 102 and 104 can be arrows indicating the direction of movement of the latch 92 and are flush with the cover 97 as illustrated in FIG. 9. The arrows 102 and 104 are preferably yellow in color while the cover as well as indicia 100 are black. These or other contrasting colors provide a pleasing aesthetic appearance.

The latch 92 also includes a channel 106 for receiving the rail portions 94 and 96. The channel 106 is defined by an arcuate base 108, a pair of opposing side walls 110 and 112, and a pair of opposing flanges 114 and 116 extending toward one another from the walls I 10 and 112. Thus, the channel 106 includes an arcuate base 108 which conforms to the arcuate rail portions 94 and 96 and has enclosed side walls 110 and 112 to slidably engage the edges 111 and 113 of the rail 90.

The width of the channel 106 between the flanges 1 14 and 116 is substantially constant over most of its length. However, one of the flanges 114 preferably includes a cut-out portion 118, which results in the width being larger than at the remaining channel length. Thus, as flange 116 is captured under the rail edge 113, and cut-out 118 is placed in contact with the rail end 111, the wider channel at the cut-out 118 enables the flange 114 to be easily snapped onto the rail end 111, thus securing the latch 92 onto the rail 90 and rail portions 94 and 96. Also, as mentioned above, the arcuate surface 108 is arcuate in shape along the channel axis as well as transverse to the channel axis, thus conforming to and following the arcuate contour of the rail 90 and enabling smooth sliding movement of the latch 92 along the rail 90.

Figure 16:
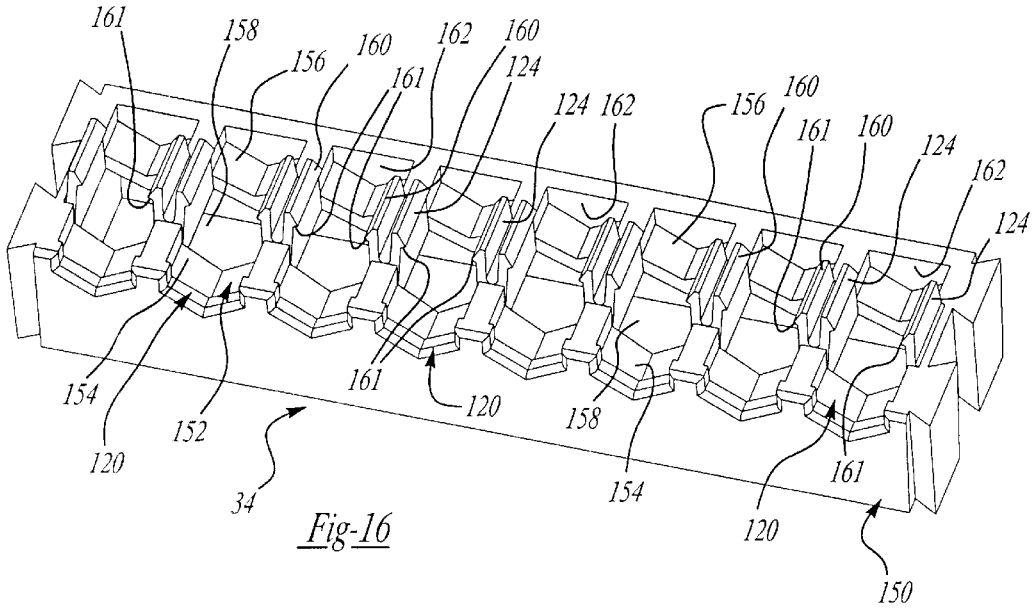
FIG. 16 is a perspective view of another tool-receiving insert in accordance with the present invention.

The tool-retaining inserts 30, 32, 34, 36 and 37 include a plurality of tool-receiving recesses 120 and a plurality of tool-retaining fingers 124 (FIGS. 5 and 16). A tool is thus placed into one of the recesses 120 and is maintained in the recess by the retaining fingers 124. The tool retaining inserts 30 and 32 may also have a stepped configuration with a plurality of curved cut-outs 126 (FIG. 5) enabling the tools to be inserted into the stepped portion.

Figure 15:
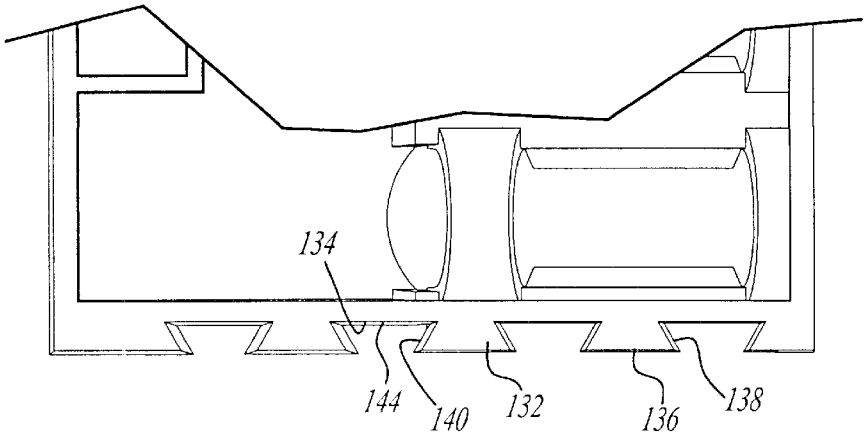
FIG. 15 is a partial top view of the tool-receiving insert of FIG. 5.

The sides of the inserts 30, 32, 34, 36 and 37 include mating tenons and recesses 132 and 134 to mate, respectively, with recesses 76 and tenons 74, respectively, of the housing members 22, 24 (see FIGS. 5 and 14–17). The tenons 132 have preferred angled front faces 136 and preferred angled sides 138 and 140, angled with respect to the vertical at an angle of about one (1°) and two (2°) degrees, respectively. The tenons 132 are preferably wider at one end, the "top" and narrower at the opposite end, the "bottom" of the insert to define a generally trapezoidal shape. The recesses 134 are defined by the walls 138 and 140 of the tenons and include an angled base 144 (FIG. 15). The base 144 is similarly wider at the "bottom" and narrower at the "top" of the insert to define a generally trapezoidal shape. Thus, the tool retaining inserts 30, 32, 34, 36 and 37 are positioned inside of the housing members 22 and 24 so that a wedging friction fit is maintained between the housing members and the inserts. The friction fit is such that the tool retaining inserts are preferably substantially permanently maintained in the housing halves.

Figure 17:
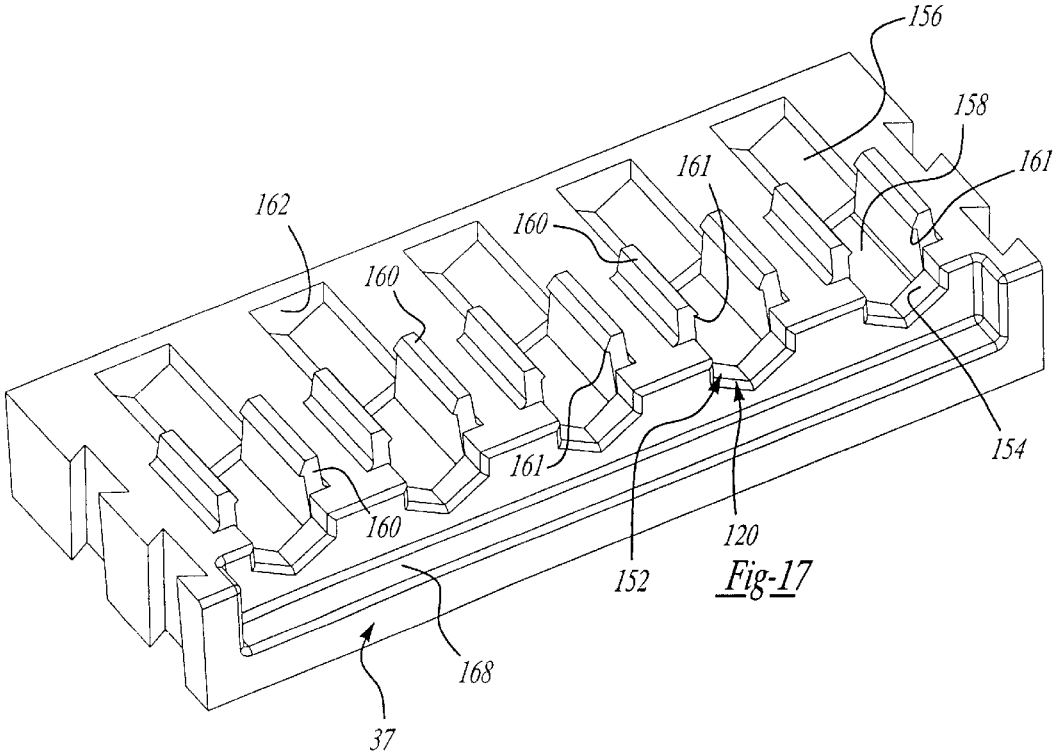
FIG. 17 is a perspective view of still another tool-receiving insert of the present invention.

FIGS. 16 and 17 illustrate perspective views of exemplary inserts 34 and 37, respectively. The insert 34 has a body 150 with eight tool receiving recesses 120, each including a pair of tool retaining fingers 124 on each side. The tool-receiving recesses 120 include a V-shaped tool receiving cradle 152 is separated into two cradle portions 154 and 156 by an aperture or opening 158. The aperture 158 enhances the molding of the insert as well as providing flex for the fingers 124 when they are spread apart to receive a tool as will be described herein.

The preferred fingers 124 of the insert 34 are positioned adjacent the aperture 158 and include barbed members 160 at their free ends. The barbs 160 include a flat surface 161 which helps to retain a tool bit in the V-shaped cradle 152. Also, an end wall member 162 is positioned on one side of the tool receiving cradles 152 to provide an abutment surface to help in the positioning of tools within the cradle 152. The exemplary insert 34 has a length or width in a longitudinal direction with respect to the elongated tools of about three-quarters (¾") of an inch. The insert 36 (shown in FIGS. 3 and 4) is substantially the same as the insert 34 except that the exemplary insert 36 has a longitudinal length about two and one-half (2½) times that of the insert 34. Thus, a "pan" portion is formed adjacent the wall 162 on the second cradle portion 156. The exemplary insert 36 has eight receiving recesses 120 similar to those described above for the insert 34.

Turning to FIG. 17, the insert 37 is similar to insert 34 except that the exemplary insert 37 includes five tool receiving recesses 120. The tool receiving recesses 120 are substantially the same as those previously described, having the V-shaped cradle 152 as well as the fingers 124. The insert 37, however, includes a stepped portion 168 which enables other types of tools such as sockets to be retained in the insert 37.

Figure 18:
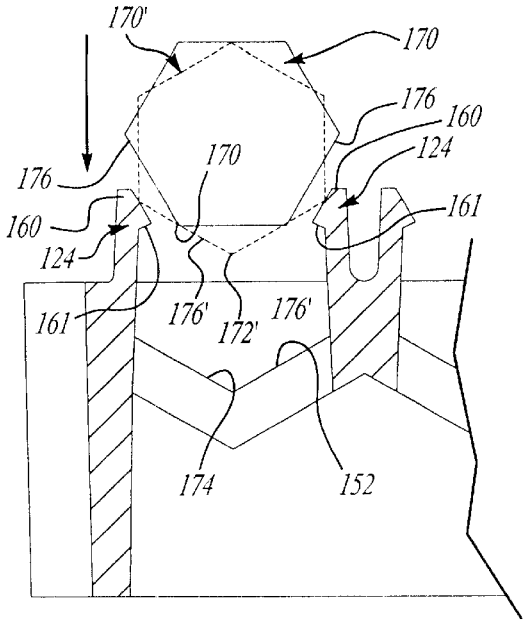
FIG. 18 is a cross-section view of the tool-receiving insert of FIG. 16 illustrating a tool inserted therein.
Figure 19:
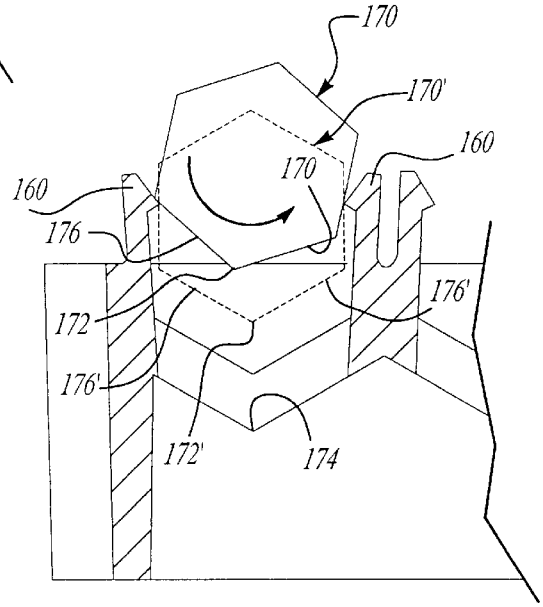
FIG. 19 is a view similar to that of FIG. 18, but illustrating the tool in a second position.
Figure 20:
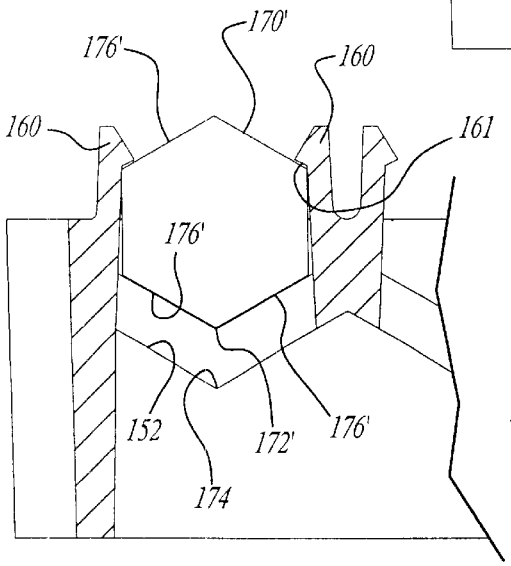
FIG. 20 is a view similar to that of FIGS. 18 and 19, but with the tool shown in a seated position.

FIGS. 18 through 20 illustrate the insertion of a polygonal cross-section shaped tool into the fingers 124 of the various inserts. As shown in FIG. 18, a tool bit 170 is positioned on top of barbs 160 of the fingers 124. The tool 170 has a hexagonal cross-section with a flat portion spanning between the two fingers 124. As the tool 170 is forced through the fingers 124, the fingers 124 spread apart with respect to one another. As the fingers 124 spread, the barbs 160 rotate the tool 170'. The rotation continues until a pair of flats 176' are between the opposing barbs 160. At that time, the tool 170' is self-orientated with an apex 172' pointed forward of the apex 174 of the V-shaped cradle 152. The tool 170' is continued to be forced down into the V-shaped cradle 152 as illustrated in FIG. 20. As this occurs, the apex 172' of the tool seats into the apex 174 of the V-shaped cradle. Thus, the fingers 124 act to self-align or self-orientate the tool 170, 170' in the V-shaped cradle 152, and the V-shaped cradle 152 receives the tool 170, 170' prohibiting any loose tools within the container.

The fingers 124 and the V-shaped cradle 152 instantly locate and orient the tool bit 170 in position in the tool receiving recess. The barb surfaces 161 seat on a flat surface 176' of the tool 170' to retain the tool within the recess. In the event an apex 172' of the tool 170' is pointing toward the apex 174 of cradle 152, as shown in phantom in FIG. 18, the fingers 124 spread and allow the tool 170' to drop directly into the cradle 152 with the tool apex 174 aligned to seat in cradle apex 172'.

Figure 21:
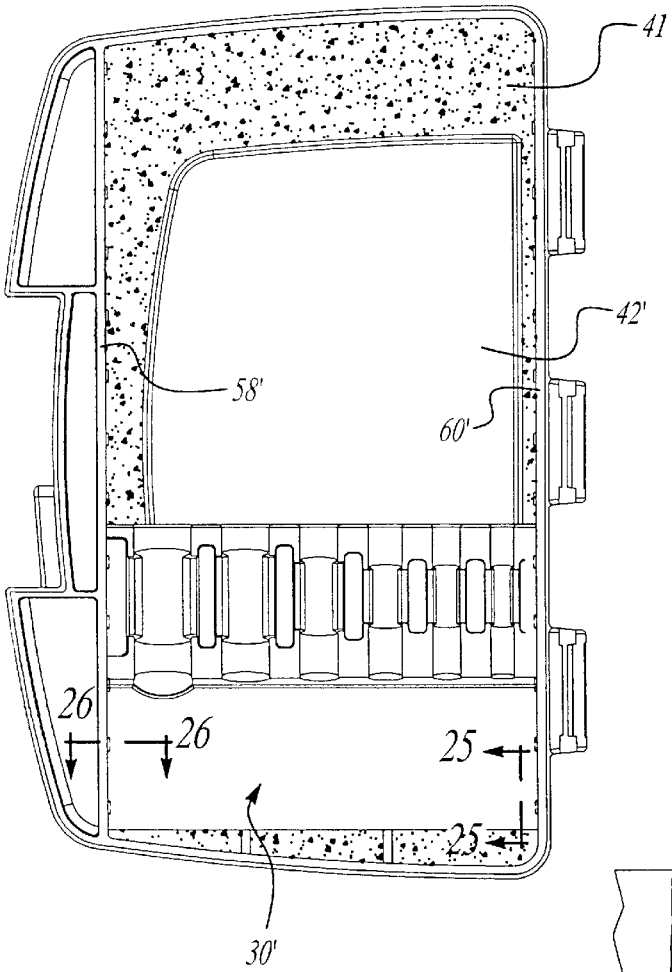
FIG. 21 is a view showing one of the tool container housing members in accordance with alternate embodiment of the present invention.
Figure 25:
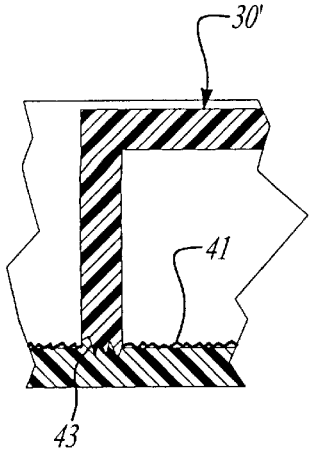
FIG. 25 a cross-section view taken generally along lines 25—25 of FIG. 21.

In FIGS. 21 through 26, other embodiments of the invention is shown, wherein the housing members of the container in FIG. 21 are the same as previously discussed, except that the dovetail walls are replaced by generally flat walls. The base 42', and the side walls 58' and 60', preferably have a roughed raised surface 41. Likewise, as shown in FIG. 25, the exemplary insert 30' includes side walls and a base which include similar roughed surfaces 43. These roughed surfaces 41 and 43 enhance ultrasonic welding, for example. The inserts may also be adhered or glued to the housing members.

Figure 22:
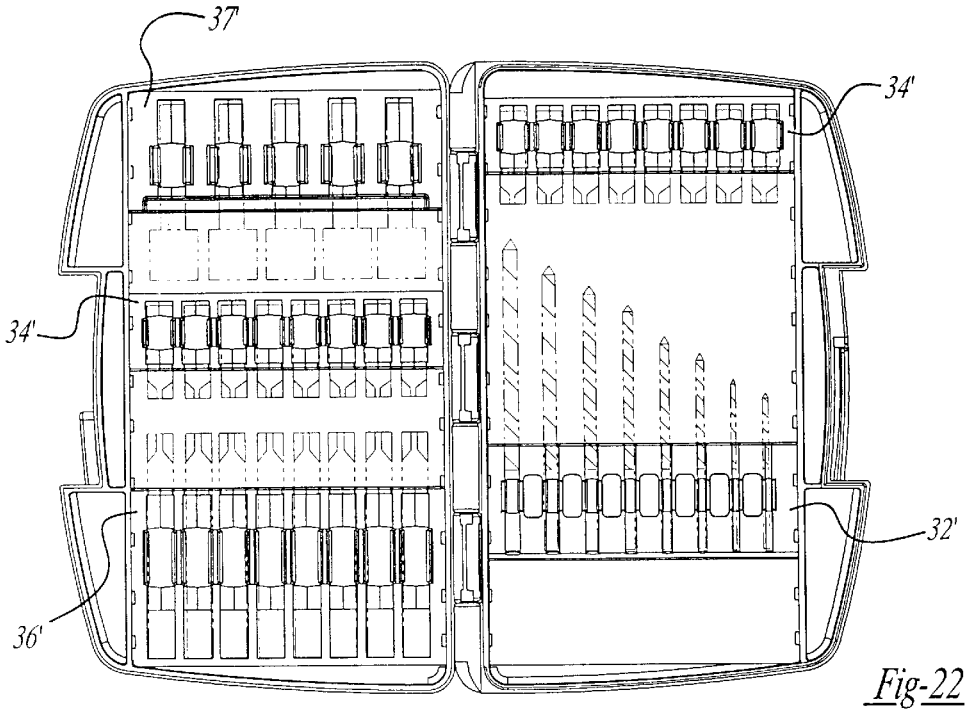
FIG. 22 is a view similar to that of FIG. 3, but illustrating the alternate embodiment of FIG. 21 with other tool-receiving inserts.
Figure 23:
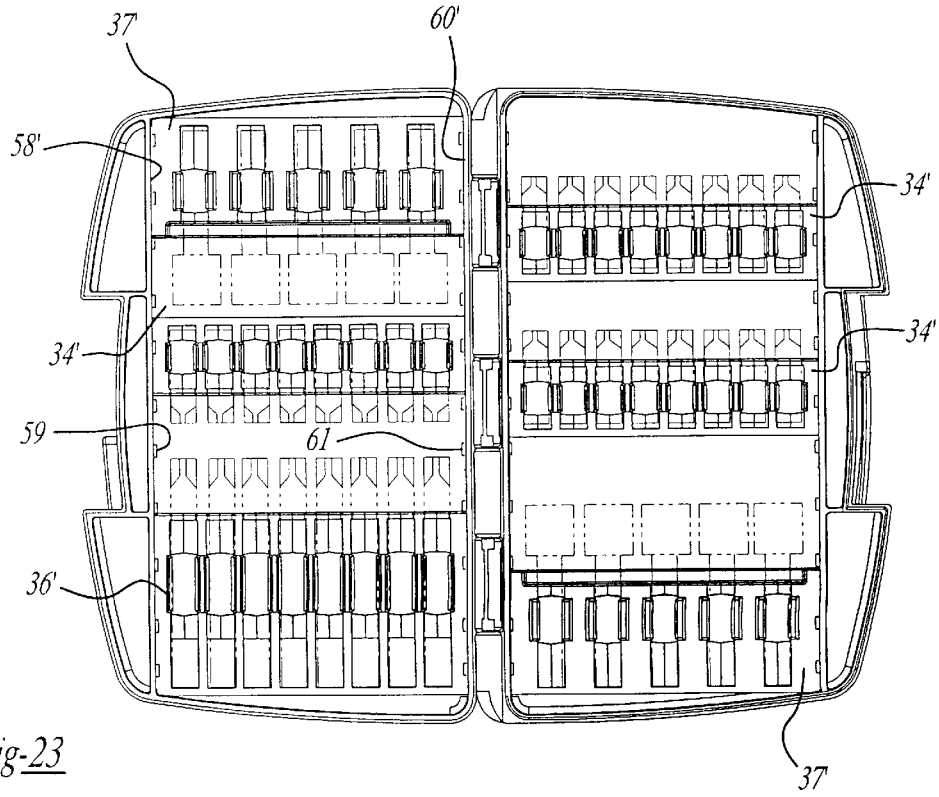
FIG. 23 is similar to that of FIG. 4 but illustrating the alternate embodiment of FIG. 21 with still other tool-receiving inserts.
Figure 26:
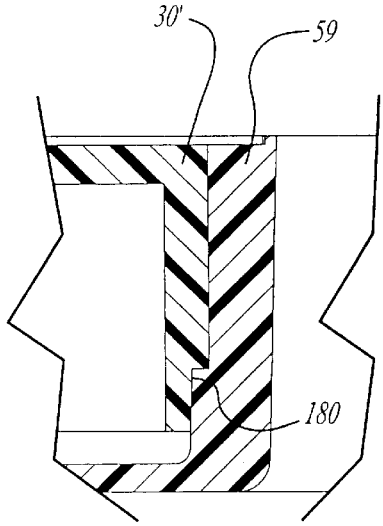
FIG. 26 is a cross-section view taken generally along lines 26—26 of FIG. 21.
Figure 24:
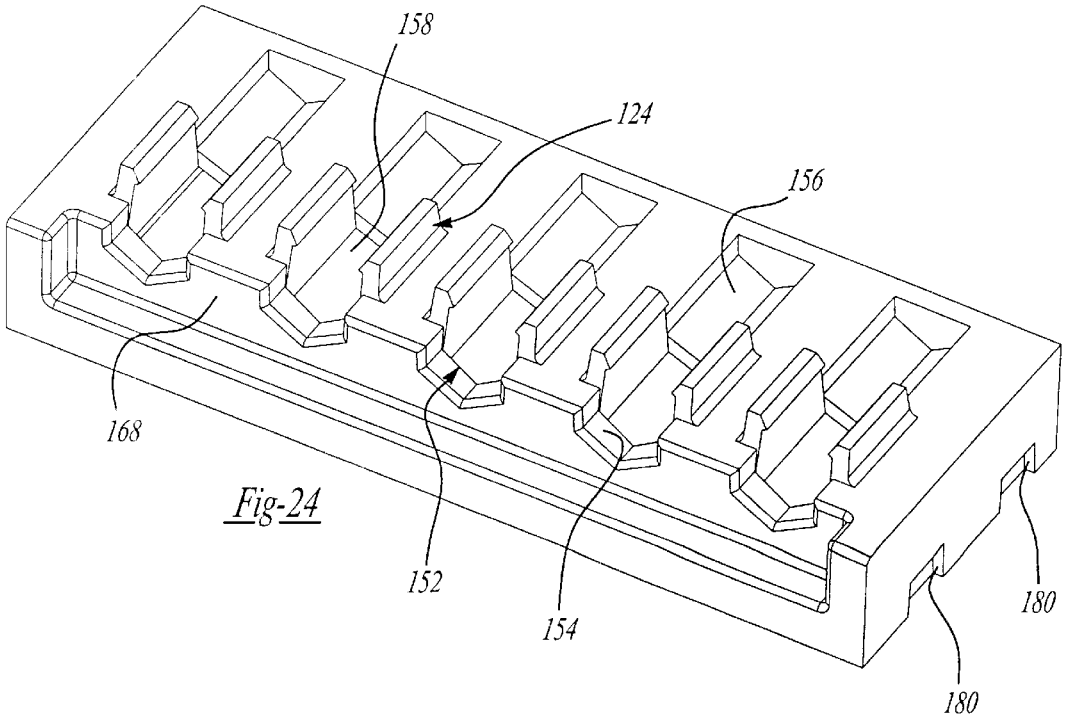
FIG. 24 a perspective view of one of the inserts of FIGS. 22 or 23.

FIGS. 22 and 23 illustrate an embodiment similar to that of FIGS. 3 and 4, wherein the inserts 34', 36' and 37' may be positioned in multiple places or various positions within the container. The inserts 34', 36' and 37' include the receiving members 120 and finger members 124 as well as the V-shaped cradles 152 described above. The walls 58' and 60', however, include tenons or projecting members 59 and 61. These projecting members 59 and 61 are spaced along the walls 58' and 60', but they do not extend vertically to the entire height of the walls 58' and 60'. The projecting members 59 and 61 act to position the inserts 30', 32', 34', 36' or 37' in the container to allow for the multiple positioning of the inserts within the housing member. The inserts include recesses or cut-outs 180 which receive the projecting members 59 and 61. The cut-outs 180 are sized to receive the projecting members 59 and 61 and are positioned such that the projecting members position the inserts along the housing member. The mating of the projecting member 59 and 61 and the recesses or cut-outs 180 enable the inserts to then be adhesively glued or ultrasonically welded, for example, in order to be secured within the housing member.

In the case of the inserts 34', 36' and 37', the insert 34' and the insert 37' would ordinarily include a single cut-out or recess 180 while the insert 36' would include two or three recesses 180 to receive the projecting members 59 and 61. Also, it should be noted that this arrangement could be reversed so that the projecting members would be positioned onto the inserts while the recesses would be formed within the walls 58' and 60'.

Figure 27:
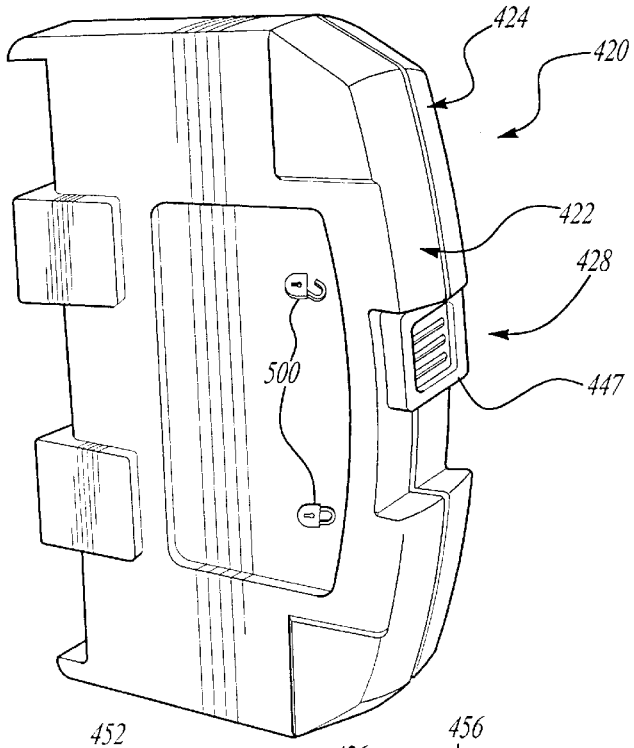
FIG. 27 is a perspective view of yet another embodiment of a tool container of the present invention shown in a closed position.
Figure 28:
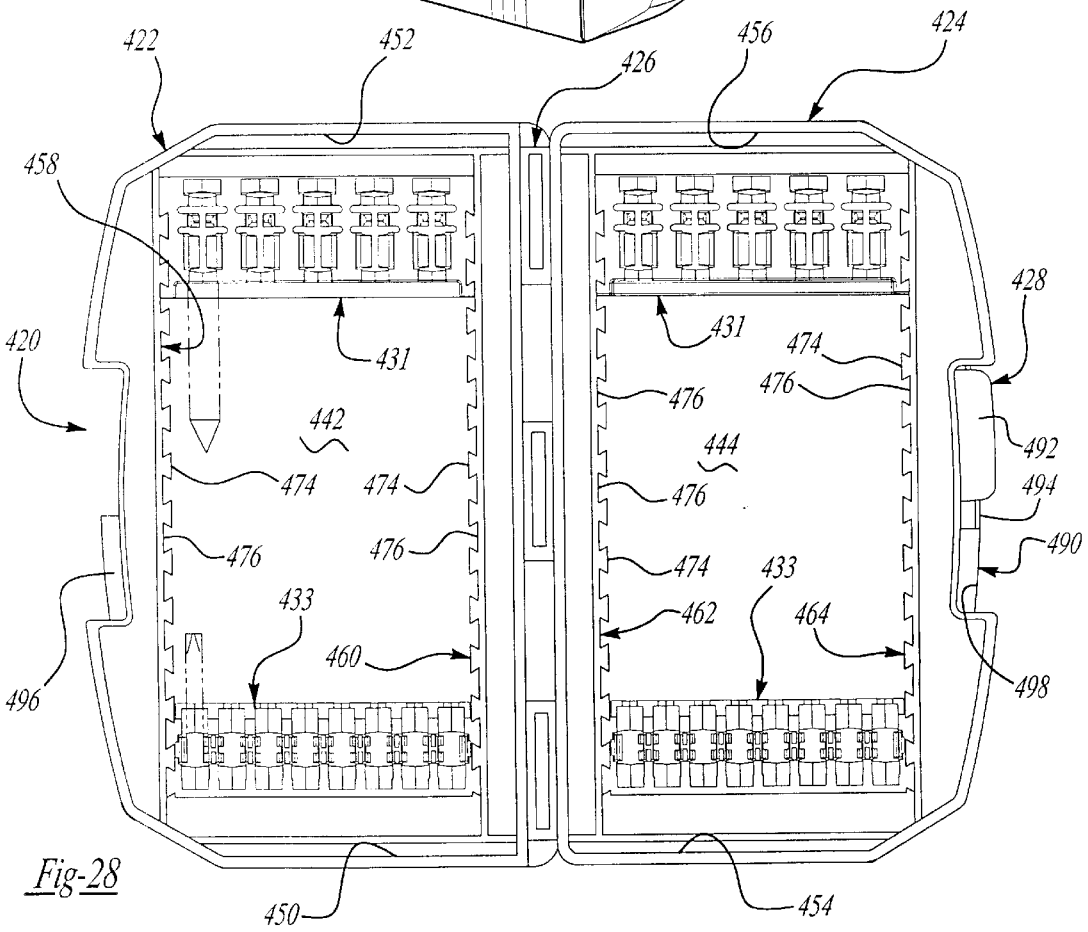
FIG. 28 is a view of the tool container of FIG. 27 shown in an open position.

FIGS. 27 and 28 illustrate yet another embodiment of a tool container according to the present invention, wherein a tool container 420 includes a pair of housing or clamshell members 422 and 424 pivotally interconnected by way of a hinge assembly 426. A latch assembly 428, generally similar to that discussed above in connection with the previously described embodiments, is slidably movable between unlocked and locked positions in order to allow the tool container to be opened and retained in a closed position respectively.

Figure 29:
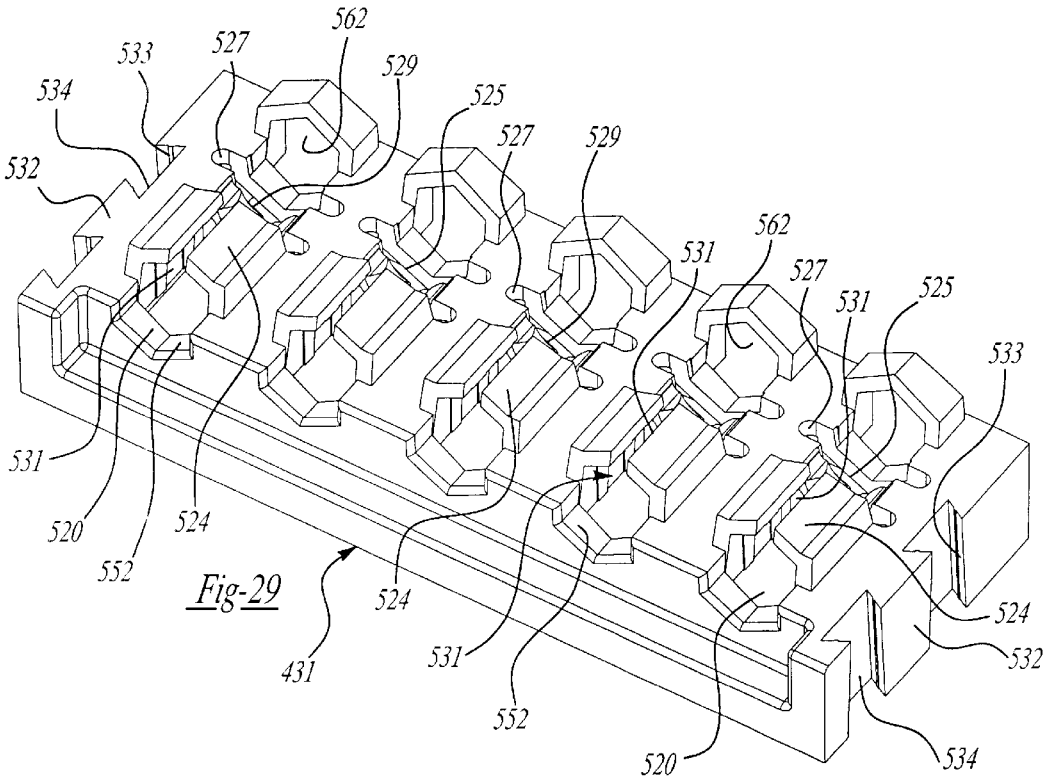
FIG. 29 is a perspective view of one of the tool-receiving inserts of FIG. 28 in accordance with the present invention.
Figure 30:
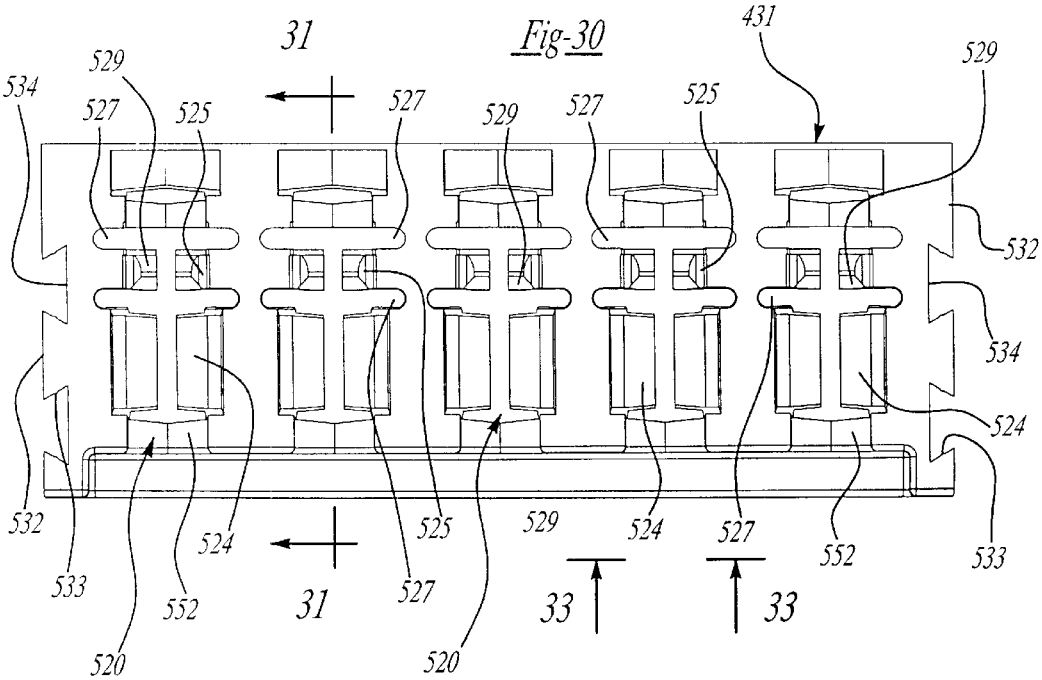
FIG. 30 top view of the tool-receiving insert of FIG. 29.

As shown in FIG. 28, the exemplary tool container 420, includes one or more tool-receiving inserts, such as the exemplary tool-receiving inserts 431 and 433. Such tool-receiving inserts 431 and 433 are secured and retained within generally hollow interior portions of the clamshell members 422 and 424. Such hollow or concave interior of the clamshell member 422 is defined by a pair of lateral walls 450 and 452 and a pair of longitudinal walls 458 and 460. Similarly, the hollow or concave interior portion of the clamshell member 424 is defined by a pair of lateral walls 454 and 456 and a pair of longitudinal walls 462 and 464. The longitudinal walls 458 and 460 of the clamshell member 422 and the longitudinal walls 462 and 464 of the clamshell member 424 each preferably include a row of longitudinally spaced-apart dovetail tenons 474, with adjacent tenons 474 being alternatingly separated by recesses 476. Such alternating dovetail tenons and recesses 474 and 476 are adapted to receiving one or more of the tool-receiving inserts 431 and 433 by way of an interlocking frictional engagement with the dovetail tenons 532 and the dovetail recesses 534 of either of the tool-receiving inserts 431 of 433, as illustrated in FIGS. 29 and 30, and in FIGS. 35 and 36, respectively.

The general shapes and configurations of the dovetail tenons 532 and the dovetail recesses 534 are substantially similar in arrangement and function to those discussed above in connection with the previously-described embodiments of the invention. However, as can be seen in FIGS. 29, 30, 35 and 36, and illustrated in greater detail in FIG. 41, the dovetail tenons 532 can be provided with tenon protrusions 533 or other protuberances or discontinuities, preferably in the form of a vertically-extending rib protruding slightly from the edges of the tenons 532 in order to enhance the tight frictional interlocking engagement of the tool-receiving inserts 431 and 433 with the dovetail tenons 474 and the dovetail recesses 476 of the clamshell members 422 and 424. In this regard, it should be noted that the materials and configurations chosen for the tool-receiving inserts 431 and 433, and for the clamshell members 422 and 424 can be selected by those skilled in the art to result in a substantially permanent frictional or wedging interlocking engagement in order to secure the tool-receiving inserts 431 and 432 in a substantially permanent installation. Alternatively, as will be readily recognized by one skilled in the art, the materials and configurations of the tool-receiving inserts 431 and 433 and of the clamshell members 422 and 424 can be made sufficiently flexible to allow the tool-receiving inserts 431 and 433 to be selectively removable and re-positionable within the clamshell members 422 and 424.

In a manner similar to that discussed above in connection with the previously-described embodiments of the invention, the latch assembly 428 includes a split rail assembly 490 upon which a latch member 492 is selectively slidably between locked and unlocked positions. As is described above, the split rail assembly 490 includes a rail portion 494 on one of the clamshell members 422 or 424, as well as a rail portion 496 on the other of the clamshell members 422 or 424. As is described above, the rail portion 494 preferably includes a cut-out portion 498 that is sized and adapted to receive the shorter rail portion 496 such that when the latch 492 is slid to its locked position it retains the rail portion 496 within the cut-out portion 498, thus releasably locking the rail portions 494 and 496, and thus the clamshell members 422 and 424, in a closed position with respect to each other. The latch assembly 428 can include the "locked" and "unlocked" indicia discussed above in connection with previously-described embodiments in the invention, or such "locked" and "unlocked" indicia 500 can be formed on one or both of the clamshell members 422 and 424 of the tool container 420, as shown in FIG. 27.

FIGS. 29 through 34 illustrate the exemplary tool-receiving insert 431, which includes a number of tool-receiving recesses 520 for removably receiving any of a plurality of tools 570. The tool-receiving recesses 520 are especially adapted to removably receive and retain tools 570 having hex-shaped shanks with a circumferentially-extending recess 571 extending therearound. One skilled in the art will readily recognize, however, that elongated tools having no shanks or shanks of other cross-sectional shapes can also be removably inserted and retained within the tool-receiving recess 520.

Figure 31:
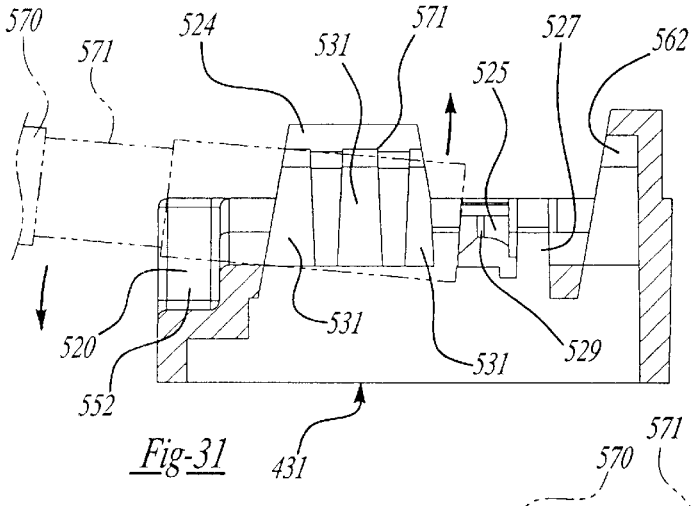
FIG. 31 is a cross-sectional view taken generally along line 31—31 of FIG. 30, illustrating a tool being inserted into the tool-receiving insert.
Figure 32:
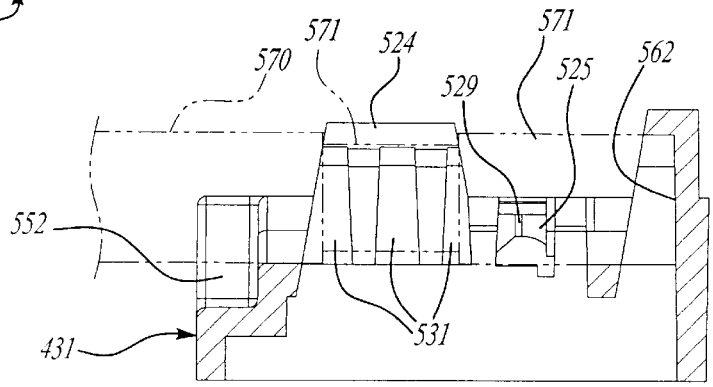
FIG. 32 is a view similar to that of FIG. 31, but showing the tool fully inserted into the tool-receiving insert.
Figure 33:
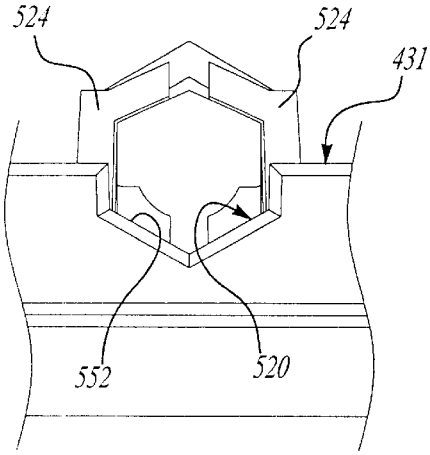
FIG. 33 is a partial view looking generally in the direction of the arrows 33 of FIG. 30.

The preferred tool-receiving recesses 520 each include a generally V-shaped cradle 552, and a pair of tool-retaining fingers 524 adjacent the V-shaped cradle 552. A second or "rear" set of tool-retaining fingers 525 is also provided within the tool-receiving recesses 520, with the second "rear" tool-retaining fingers 525 having open spaces 527 disposed on either side. The second or "rear" set of tool-retaining fingers are adapted to engage the tool 570 on an opposite side thereof from the first set of tool-retaining fingers 524. In this regard, the second or "rear" set of tool-retaining fingers 525 preferably include finger protrusions 529 protruding inwardly therefrom in a direction toward the tool 570. Thus, as a tool 570 is being inserted into the tool-receiving recess 520, as illustrated in FIG. 31, its end first engages the flexible "rear" set of tool-retaining fingers 525, which resiliently deflect as the tool 570 is inserted and pushed toward the end wall socket portion 562. Once the tool 570 has been fully inserted, however, as illustrated in FIGS. 32 and 33, the finger protrusions 529 on the "rear" fingers 525 serve to resiliently urge the tool 570 "upwardly" toward the tool-retaining fingers 524, thus assuring a snug engagement so that the tool 570 will not rattle or slide out of the tool-receiving recess until it is purposefully removed by the user.

Figure 34:
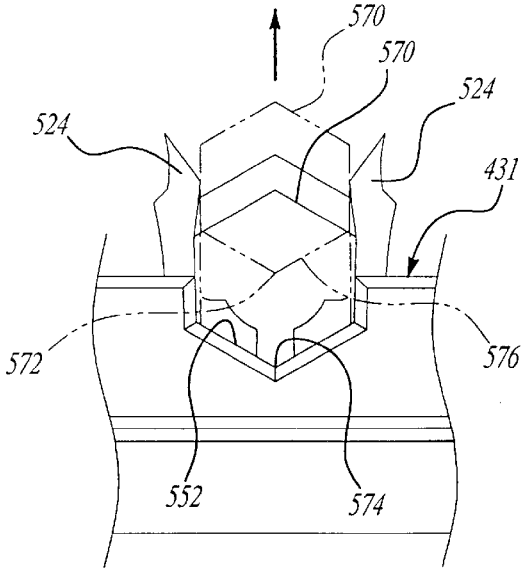
FIG. 34 is a similar to that of FIG. 33, but illustrating a tool being removed from the tool-receiving insert.

When the user wishes to remove the tool 570 from the tool-receiving recess of the tool-retaining insert 431, he or she merely lifts the free end of the tool 570 upwardly, as illustrated in FIG. 34. Such upward movement of the tool 570, with the end of the tool 570 pivoting within the end wall socket portion 562, forces the first tool-retaining fingers 524 to resiliently deflect and spread until the tool 570 passes beyond them and is then free for easy removal from the tool-receiving recess 520. Alternatively, the user can remove the tool 570 from the tool-receiving recess 520 by merely sliding the tool 570 longitudinally outwardly from the tool-receiving recess 520. Once the tool 570 passes beyond the finger protrusions 529 on the "rear" tool-retaining fingers 525, the tool 570 becomes more loosely retained and is thus free to be easily slid from engagement with the tool-retaining fingers 524 and hence outwardly from the tool-receiving recess 520.

FIGS. 35 through 39 illustrate the exemplary tool-receiving insert 433, which includes a number of tool-receiving recesses 620 for removably receiving any of a plurality of tools 670 adapted especially for removably retaining tool items with hex-shaped shanks, but also capable of retaining shankless tools or tools having other cross-sectional shapes.

Such tool-receiving recesses 620 include generally V-shaped cradles 652 and a ridge 635 at their outer ends. Opposed split or spaced-apart tool-retaining fingers 624 are provided, but with adjacent tool-retaining fingers 624 on adjacent tool-receiving recesses 620 being interconnected by a connecting wall 665, which is perhaps best seen in FIGS. 35 and 36. Such tool-retaining fingers 624 are generally aligned longitudinally with the open spaces 627 within each tool-receiving recess 620 and substantially divide each open space 627 into two open spaces on either longitudinal side of the split tool-retaining fingers 624 and one open space longitudinally between the longitudinally split pairs of fingers. This results effectively in first and second sets or pairs of tool-retaining fingers 624 in each tool-receiving recess 620, with each pair having open spaces 627 on each longitudinal side. Each of the sets of tool-retaining fingers 624 on each tool-receiving recess 620 preferably includes a barbed portion 660 with a generally flat lower surface 661. At the inward end of each tool-receiving recess 620 an end wall 662 is provided with one or more steps 678 on adjacent side walls.

Figure 37:
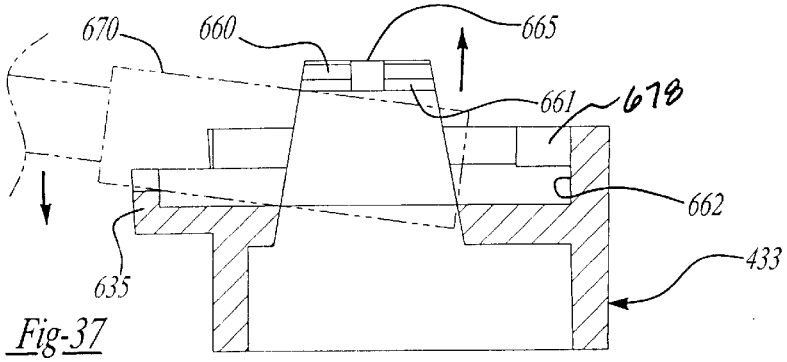
FIG. 37. is a cross-sectional view taken generally along line 37—37 of FIG. 36, illustrating a to being inserted into the tool-receiving insert.
Figure 38:
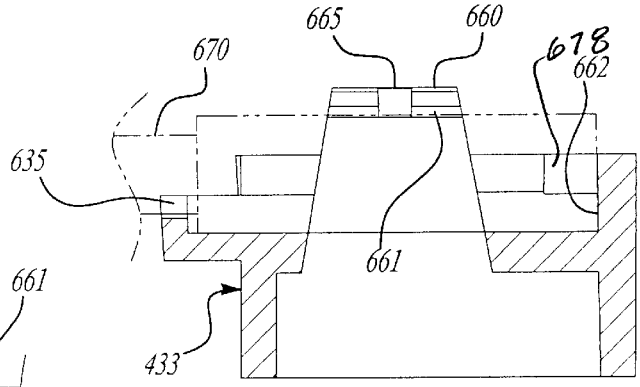
FIG. 38 is a view similar to that of FIG. 37, but showing the tool fully inserted into the tool-receiving insert.
Figure 39:
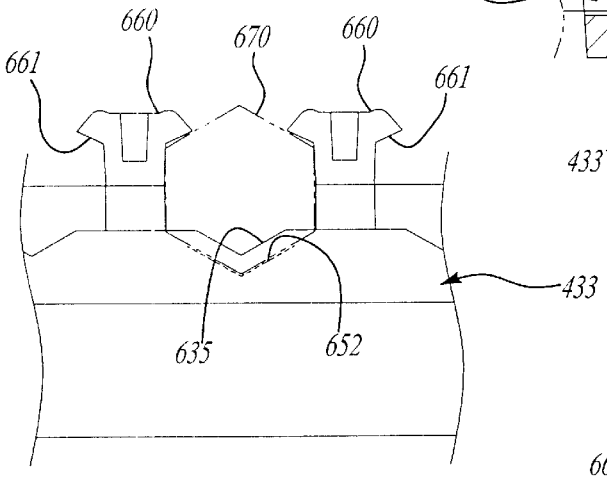
FIG. 39 is a partial view looking generally in the direction of arrows 39 of FIG. 36.

As is illustrated in FIGS. 37 and 38, a tool 670 is preferably inserted into the tool-receiving recess 620 at a slight angle in order to clear the outer ridge 635 and begin to slide under the flat surfaces 661 of the barbs 660 of the tool-retaining fingers 624. At this position, as illustrated in FIG. 37, the inner end of the tool 670 first abuts the rear portion of the V-shaped cradles 652 but is then pushed downwardly by the user at its free end in order to cause the tool 670 to pivot about the ridge 635 in order to allow the inner end to clear the rear portion of the V-shaped cradle 652. The tool 670 can then be slid into contact with the end wall 662, with the steps 678 tending to wedge or frictionally engage the inner end of the tool bit 670 to retain it in place, as shown in FIGS. 38 and 39.

Figure 40:
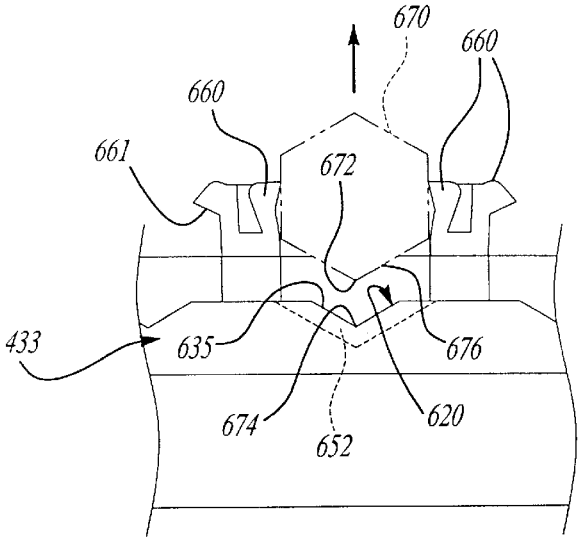
FIG. 40 is a view similar to that of FIG. 39, but illustrating a tool being removed from the tool-receiving insert.
Figure 41:
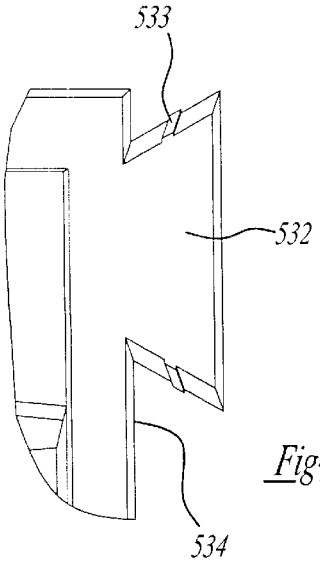
FIG. 41 is a detailed view illustrating the ribbed dovetail portion of one or both of the tool-receiving inserts of FIG. 28.

In a manner similar to that described above in connection with the tool 570 and the tool-retaining insert 431, the tool 670 can be removed by lifting its free end upwardly so that its inner end pivots with respect to the end wall 662, thus spreading the resilient tool-retaining fingers 624, as is illustrated in FIG. 40, until the tool 670 is free from the tool-receiving recess 620. Alternatively, the tool 670 can be merely slid longitudinally outwardly free from the tool-receiving recess 620.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed is:

1. A tool container, comprising:

at least two housing members pivotally coupled with one another for opening and closing with respect to one another, at least one housing member defining a cavity for receiving tools, said cavity defined by a base and a wall extending from said base, said wall having alternating wall dovetail recesses and wall dovetail tenons thereon;

an insert for retaining tools, said insert being secured in said cavity, said insert having alternating insert dovetail recesses and insert dovetail tenons thereon interlockingly engageable with said alternating wall dovetail recesses and wall dovetail tenons for securing said insert to said housing member; and a protrusion on at least one side wall of one of said wall dovetail tenons and said insert dovetail tenons.

2. A tool container according to claim 1, wherein said protrusion is on at least one side wall of each of said insert dovetail tenons.

3. A tool container according to claim 1, wherein said protrusion is on at least one side wall of each of said wall dovetail tenons.

4. A tool container according to claim 1, wherein each of said wall dovetail tenons and each of said insert dovetail tenons have a front face that is angled at about one (1°) degree with respect to a vertical direction.

5. A tool container according to claim 4, wherein each of said wall dovetail recesses and each of said insert dovetail recesses have faces that are at angles corresponding with the angles of said front faces of said insert dovetail tenons and said wall dovetail tenons, respectively, for frictional locking of said insert and said housing member together.

6. A tool container according to claim 1, wherein said insert includes a plurality of tool-receiving recesses therein, each of said tool-receiving recesses including a cradle portion and at least a first pair of tool-retaining fingers on an opposite side from said cradle portions, each of said tool-receiving recess further including at least a second pair of tool-retaining fingers on the same side as said cradle portion, said first and second pairs of tool-retaining fingers resiliently engaging an elongated tool on opposite sides thereof when said elongate tool is inserted into said tool-receiving recess.

7. A tool container according to claim 6, wherein each of said tool-receiving recesses further includes an inner end socket portion therein.

8. A tool container according to claim 6, wherein at least second tool-retaining fingers each include a protrusion thereon for engaging said inserted elongated tool.

9. A tool-receiving insert for a tool container having at least two housing members pivotally coupled with one another for opening and closing with respect to one another, at least one housing member defining a cavity for receiving tools, said cavity defined by a base and a wall extending from said base, said wall having alternating wall dovetail recesses and wall dovetail tenons thereon, said insert having alternating insert dovetail recesses and insert dovetail tenons thereon interlockingly engageable with said alternating wall dovetail recesses and wall dovetail tenons for securing said insert to said housing member; and a protrusion on at least one side wall of one of said wall dovetail tenons and said insert dovetail tenons.

10. A tool-receiving insert according to claim 9, wherein said protrusion is on at least one side wall of each of said insert dovetail tenons.

11. A tool-receiving insert according to claim 9, wherein said protrusion is on at least one side wall of each of said wall dovetail tenons.

12. A tool-receiving insert according to claim 9, wherein each of said wall dovetail tenons and each of said insert dovetail tenons have a front face that is angled at about one (1°) degree with respect to a vertical direction.

13. A tool-receiving insert according to claim 12, wherein each of said wall dovetail recesses and each of said insert dovetail recesses have faces that are at angles corresponding with the angles of said front faces of said insert dovetail tenons and said wall dovetail tenons, respectively, for frictional locking of said insert and said housing member together.

14. A tool-receiving insert according to claim 9, wherein said insert includes a plurality of tool-receiving recesses therein, each of said tool-receiving recesses including a cradle portion and at least a first pair of tool-retaining fingers on an opposite side from said cradle portions, each of said tool-receiving recess further including at least a second pair of tool-retaining fingers on the same side as said cradle portion, said first and second pairs of tool-retaining fingers resiliently engaging an elongated tool on opposite sides thereof when said elongate tool is inserted into said tool-receiving recess.

15. A tool-receiving insert according to claim 14, wherein each of said tool-receiving recesses further includes an inner end socket portion therein.

16. A tool-receiving insert according to claim 14, wherein at least second tool-retaining fingers each include a protrusion thereon for engaging said inserted elongated tool.

17. A tool container, comprising:

at least two housing members pivotally coupled with one another for opening and closing with respect to one another, at least one housing member defining a cavity for receiving tools, said cavity defined by a base and a wall extending from said base, said wall having alternating wall dovetail recesses and wall dovetail tenons thereon;

an insert for retaining tools, said insert being secured in said cavity, said insert having alternating insert dovetail recesses and insert dovetail tenons thereon interlockingly engageable with said alternating wall dovetail recesses and wall dovetail tenons for securing said insert to said housing member;

a protrusion on at least one side of one of said wall dovetail tenons and said insert dovetail tenons, each of said wall dovetail tenons and each of said insert dovetail tenons having a front face that is angled at about one (1°) degree with respect to a vertical direction, each of said wall dovetail recesses and each of said insert dovetail recesses having faces that are at angles corresponding with the angles of said front faces of said insert dovetail tenons and said wall dovetail tenons, respectively, for frictional locking of said insert and said housing member together; and said insert including a plurality of tool-receiving recesses therein, each of said tool-receiving recesses including a cradle portion and at least a first pair of tool-retaining fingers on an opposite side from said cradle portions, each of said tool-receiving recess further including at least a second pair of tool-retaining fingers on the same side as said cradle portion, said first and second pairs of tool-retaining fingers resiliently engaging an elongated tool on opposite sides thereof when said elongate tool is inserted into said tool-receiving recess.

18. A tool container according to claim 17, wherein said protrusion is on at least one side of each of said insert dovetail tenons.

19. A tool container according to claim 17, wherein said protrusion is on at least one side of each of said wall dovetail tenons.

20. A tool container according to claim 17, wherein each of said tool-receiving recesses further includes an inner end socket portion therein.

21. A tool container according to claim 17, wherein at least second tool-retaining fingers each include a protrusion thereon for engaging said inserted elongated tool.

22. A tool container, comprising:

at least two housing members pivotally coupled with one another for opening and closing with respect to one another, at least one housing member defining a cavity for receiving tools, said cavity defined by a base and a wall extending from said base;

an insert for retaining tools, said insert being secured in said cavity, said insert includes a plurality of tool-receiving recesses therein, each of said tool-receiving recesses including a cradle portion and at least a first pair of tool-retaining fingers on an opposite side from said cradle portions, each of said tool-receiving recess further including at least a second pair of tool-retaining fingers on the same side as said cradle portion, said first and second pairs of tool-retaining fingers resiliently engaging an elongated tool on opposite sides thereof when said elongate tool is inserted into said tool-receiving recess.

* * * * *